US008388108B2

(12) United States Patent
Byun et al.

(10) Patent No.: US 8,388,108 B2
(45) Date of Patent: Mar. 5, 2013

(54) LIQUID DROPLET SPRAYING APPARATUS AND METHOD

(75) Inventors: Do Young Byun, Seoul (KR); Vu Dat Nguyen, Seoul (KR)

(73) Assignee: Enjet Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/143,980

(22) PCT Filed: Feb. 11, 2009

(86) PCT No.: PCT/KR2009/000626

§ 371 (c)(1),
(2), (4) Date: Aug. 10, 2011

(87) PCT Pub. No.: WO2010/079859

PCT Pub. Date: Jul. 15, 2010

(65) Prior Publication Data

US 2011/0285792 A1 Nov. 24, 2011

(30) Foreign Application Priority Data

Jan. 12, 2009 (KR) ..... 10-2009-0002166
Jan. 14, 2009 (KR) ..... 10-2009-0002928
Jan. 20, 2009 (KR) ..... 10-2009-0004636

(51) Int. Cl.
*B41J 2/04* (2006.01)

(52) U.S. Cl. ..... 347/54; 347/55; 347/47

(58) Field of Classification Search ..... 347/9–11, 347/17, 44, 47, 54–56, 61–62, 84–86, 94
See application file for complete search history.

(56) References Cited

U.S. PATENT DOCUMENTS 4,333,086 A * 6/1982 Ebi ..... 347/55
4,419,673 A * 12/1983 Ebi et al. ..... 347/48

(Continued)

FOREIGN PATENT DOCUMENTS

JP 4083644 A 3/1992
JP 10138494 A 5/1998

(Continued)

OTHER PUBLICATIONS

Abstract of Korean Patent No. KR20050054962 dated Jun. 10, 2005, 1 page.

(Continued)

*Primary Examiner* — Juanita D Jackson
(74) *Attorney, Agent, or Firm* — Dority & Manning, P.A.

(57) ABSTRACT

The liquid droplet spraying apparatus includes a chamber containing a fluid; a nozzle body having a nozzle for spraying the fluid in the chamber to one side of a material to be printed; an electrostatic spray module which is arranged in the vicinity of the chamber or the nozzle, and which forms an electrostatic field for the fluid contained in the chamber to provide a first spray force for spraying the fluid via the nozzle to form a liquid droplet; a physical spray module which is arranged in the chamber and opposite the nozzle, and which provides a second spray force for assisting the first spray force when the first spray force is generated; and a control unit for controlling the electrostatic spray module and the physical spray module such that the first spray force and the second spray force can be provided in a specific pattern.

The liquid droplet spraying apparatus includes a chamber containing a fluid; a nozzle body having a nozzle for spraying the fluid in the chamber to one side of a material to be printed; an electrostatic spray module which is arranged in the vicinity of the chamber or the nozzle, and which forms an electrostatic field for the fluid contained in the chamber to provide a first spray force for spraying the fluid via the nozzle to form a liquid droplet; a physical spray module which is arranged in the chamber and opposite the nozzle, and which provides a second spray force for assisting the first spray force when the first spray force is generated; and a control unit for controlling the electrostatic spray module and the physical spray module such that the first spray force and the second spray force can be provided in a specific pattern.

9 Claims, 26 Drawing Sheets

U.S. PATENT DOCUMENTS

| | | | | |
|---|---|---|---|---|
| 7,427,124 | B2 * | 9/2008 | Kusakari | 347/55 |
| 7,588,320 | B2 * | 9/2009 | Lee et al. | 347/55 |

FOREIGN PATENT DOCUMENTS

| | | | |
|---|---|---|---|
| JP | 10202881 | A | 8/1998 |
| JP | 2005047049 | A | 2/2005 |
| JP | 2005059215 | A | 3/2005 |
| JP | 200682265 | A | 3/2006 |
| JP | 2007181971 | A | 7/2007 |
| KR | 20050054962 | A | 6/2005 |
| KR | 200622367 | A | 3/2006 |
| KR | 10596200 | B | 6/2006 |

OTHER PUBLICATIONS

Search Report for PCT/KR2009/000626, dated Feb. 18, 2010, 2 pages.

* cited by examiner

LIQUID DROPLET SPRAYING APPARATUS AND METHOD

CROSS REFERENCE TO RELATED APPLICATION

This application is the national stage entry of International Patent Application No. PCT/KR2009/000626 having a filing date of Feb. 11, 2009, which claims priority to and the benefit of Korean Patent Application No. 10-2009-0002166 filed in the Korean Intellectual Property Office on Jan. 12, 2009, Korean Patent Application No. 10-2009-0002928 filed in the Korean Intellectual Property Office on Jan. 14, 2009, and Korean Patent Application No. 10-2009-0004636 filed in the Korean Intellectual Property Office on Jan. 20, 2009, the entire contents of which are incorporated herein by reference.

BACKGROUND OF THE INVENTION (a) Field of the Invention

The present invention relates to a liquid droplet spraying apparatus and method, and more particularly to a liquid droplet spraying apparatus and method which can minutely and efficiently spray fluid in the form of a liquid droplet by applying an electrostatic field to a surface of the fluid sprayed through a nozzle and accessorily applying a physical spraying force.

(b) Description of the Related Art

Generally, a liquid droplet spraying apparatus for spraying fluid in the form of the liquid droplet has been variously applied to an inkjet printer, and has recently been applied and developed to be used in a state-of-the art high value-added field such as a display process apparatus, a printed-circuit-board process apparatus, and a deoxyribonucleic acid (DNA) chip manufacturing process.

In the inkjet printer, an ink spraying apparatus for spraying ink in the form of a liquid droplet is divided into a thermal driving type and an electrostatic type.

First, as shown in FIGS. 1 and 2, the thermal driving type ink spraying apparatus includes a manifold 22 provided in a substrate 10, an ink channel 24 and an ink chamber 26 defined and constrained by a partition wall 14 formed on the substrate 10, a heater 12 provided in the ink chamber 26, and a nozzle 16 provided in a nozzle plate 18 and spraying an ink droplet 29'. Such a thermal driving type ink spraying apparatus sprays the ink droplet 29' through the following operations.

The heater 12 generates heat when receiving voltage, and thus ink 29 contained in the ink chamber 26 is heated while generating bubbles 28.

Then, the generated bubbles 28 are continuously expanded, and pressure is applied to the ink 29 contained in the ink chamber 26, so that the ink droplet 29' can be sprayed by the nozzle 16 to the outside of the nozzle 16.

Then, the ink 29 is absorbed from the manifold 22 to the ink chamber 26 via the ink channel 24, so that the ink chamber 26 can be recontaining the ink 29.

However, as described above, a conventional thermal driving type ink spraying apparatus may cause the ink 29 to be chemically changed by the heat of the heater for forming the bubbles, and therefore have shortcomings that a problem such as deterioration in quality of the ink 29 may arise.

Also, the droplet 29' of the ink sprayed through the nozzle 16 may be rapidly changed in volume due to heat of the heater 12 while moving toward an object such as paper, and also have a problem of deterioration in print quality such as resolution.

Further, the thermal driving type ink spraying apparatus has a problem that there is a limit to minute control for the ink droplet 29' sprayed through the nozzle 16, e.g., control for the size and shape of ink droplet.

The above problems bring another problem of difficulty in embodying a high-integration liquid droplet spraying apparatus.

Meanwhile, FIGS. 3 and 4 illustrate another type of a liquid droplet spraying apparatus, i.e., an electrostatic type liquid droplet spraying apparatus using an electric field.

More specifically, as shown in FIGS. 3 and 4, the electrostatic type liquid droplet spraying apparatus includes a base electrode 32 and an opposite electrode 33 placed opposite the base electrode 32. Ink 31 is contained between the two electrodes 32 and 33, and a direct current (DC) power source 34 is connected to the two electrodes 32 and 33.

When voltage is applied from the DC power source 34 to the electrodes 32 and 33, an electrostatic field is formed between the two electrodes 32 and 33.

Thus, Coulomb's force is applied to the ink 31 in a direction toward the opposite electrode 33.

On the other hand, the ink 31 has a repulsive force to the Coulomb's force the ink 31 because of its own surface tension, viscosity, etc., and is thus not easy to be sprayed in the direction toward the opposite electrode 33.

Accordingly, in order to separate a liquid droplet from the surface of the ink 31 and spray it, a very high voltage of 1 kV or higher has to be applied between the electrodes 32 and 33.

However, if high voltage is applied between the electrodes 32 and 33, the liquid droplet is very irregularly sprayed and therefore a predetermined portion of the ink 31 is locally heated.

That is, temperature T1 of ink 31' located in a region S1 increases higher than temperature T0 of ink 31 located in other regions. Therefore, the ink 31' of the region S1 is expanded, and the electrostatic field is concentrated on this region so that a lot of electrons can be collected in this region.

Since the repulsive force between the electrons and the Coulomb's force based on the electrostatic field are exerted upon the ink 31' of the region S1, a liquid droplet is separated from the ink 31' of the region S1 and moves toward the opposite electrode 33 as shown in FIG. 4.

FIG. 5 shows an electrostatic type ink spraying method. There is a nozzle 4 provided with an electrode 6, and an opposite electrode 7 is placed under a substrate 8, so that a liquid droplet can be discharged and sprayed to a substrate 8 on the foregoing principle. Voltage is applied by supplying DC power in the form of pulse between the electrode 6 of the nozzle 4 and the opposite electrode 7.

In such a manner, there have been continuously reported research results and relevant antecedent patents that show successful jetting and patterning.

However, the above electrostatic type liquid droplet spraying apparatus has the following problems or shortcomings to be overcome. There are problem that the very high voltage of 1 kV or higher has to be applied to the electrode 6, the nozzle 4 has to be internally provided with the electrode, and the opposite electrode 7 has to be externally provided in a nozzle direction or under the substrate 8. To place the electrode 6 inside the nozzle 4, a very complicated process is needed. Also, while discharging the liquid droplet in a direction toward the opposite electrode 7, there may be instability that a single liquid droplet may be shredded and sprayed. In the case that the nozzle 4 approaches the substrate 8 in order to improve directionality of a liquid droplet, there is a limit to an approaching distance because of an electrical breakdown. Since the discharged liquid droplet basically possesses an electrical charge, there is force acting between a liquid surface existing on the nozzle 4 and the substrate 8, and thus a moving direction of the liquid droplet is distorted in the vicinity of the substrate. Last, an electric current flowing in the ink may cause an electro-chemical reaction.

SUMMARY OF THE INVENTION

Accordingly, the present invention is conceived to solve the forgoing problems, and an aspect of the present invention is to provide a liquid droplet spraying apparatus and method, in which a hyperfine liquid droplet can be formed as a very small diameter of a nozzle is achieved by applying an electrostatic field onto a surface of fluid to generate a first spray force for generating the liquid droplet and at the same time accessorily applying a physical second spray force for spraying the fluid, and the fluid can be minutely and efficiently sprayed in the form of a liquid droplet by controlling the first spray force based on the electrostatic field and the second spray based on the physical force simultaneously.

Another aspect of the present invention is to provide a liquid droplet spraying apparatus and method which can spray a liquid droplet through a nozzle of a nozzle body by applying an alternating current signal to electrodes respectively provided in an inner side and a lateral side of the nozzle even though there is no electrode for inducing a liquid droplet to be jetted in a spraying direction so as to overcome the problems of needing an opposite electrode is needed in a nozzle direction or under the substrate.

Still another aspect of the present invention is to provide a liquid droplet spraying apparatus and method in which a liquid droplet can be sprayed through a nozzle of a nozzle body by applying an alternating current signal to only an electrode module provided outside the nozzle body in order to solve the problems of difficulty in forming the electrode inside the nozzle and an electrical breakdown and improve directionality of the liquid droplet, and the spray of the liquid droplet through the nozzle of the nozzle body can be controlled by superimposing and applying a pulse signal to the electrode module in the state that the electrode module is biased by the alternating current signal.

An exemplary embodiment of the present invention provides a liquid droplet spraying apparatus with a nozzle body that includes a chamber containing a fluid, and a nozzle for spraying the fluid contained in the chamber toward one side of a material to be printed, the liquid droplet spray method apparatus including: an electrostatic spray module which is arranged in the vicinity of the chamber or the nozzle, forms an electrostatic field in the fluid contained in the chamber to provide a first spray force so that the fluid can be sprayed through the nozzle to form a liquid droplet; a physical spray module which is arranged inside the chamber and opposite the nozzle, and provides a second spray force for assisting the first spray force when the first spray force is generated; and a control unit which controls the electrostatic spray module and the physical spray module so that the first spray force and the second spray force can be provided in a specific pattern.

The electrostatic spray module may include a first electrode unit arranged to be spaced apart from the nozzle, a second electrode unit arranged in an inside of the nozzle, and an electrostatic signaler applying an electrostatic signal between the first electrode unit and the second electrode unit.

The first electrode unit may include a plurality of stack electrodes stacked as being spaced apart from each other.

The first electrode unit may include a front electrode arranged to be spaced apart from the nozzle, and a rear electrode arranged to be attached to or spaced part from the other side of the material to be printed.

The physical spray module may include a piezoelectric operator or a heating operator, and a driving signaler for applying a driving signal to the piezoelectric operator or the heating operator.

The electrostatic spray module may include an electrode module unit arranged to be spaced apart from the nozzle, and an alternating current signaler for applying an alternating current signal to the electrode module unit.

The electrode module units may be arranged to be spaced apart at opposite sides of the nozzle.

The alternating current signal may include a sine wave signal in the form of an alternating current.

The electrode module unit may include a plurality of stack modules stacked as being spaced apart from each other.

The electrode module unit may include a front module arranged to be spaced apart from the nozzle, and a rear module arranged to be attached to or spaced part from the other side of the material to be printed.

The nozzle bodies may be arranged in plural neighboring to each other with insulating spacers therebetween, and each electrostatic spray module and each physical spray module of the plural nozzle bodies arranged neighboring to each other are individually controlled.

The nozzle of the nozzle body may include a conductive material.

The nozzle of the nozzle body includes a non-conductive material in which a conductive wire is embedded.

Another exemplary embodiment of the present invention provides a liquid droplet spray method using a liquid droplet spraying apparatus with a nozzle body that includes a chamber containing a fluid, and a nozzle for spraying the fluid contained in the chamber toward one side of a material to be printed, the liquid droplet spray method including: forming an electrostatic field in the fluid contained in the chamber using an electrostatic spray module arranged in the vicinity of the chamber or the nozzle to provide a first spray force for spraying the fluid via the nozzle to form a liquid droplet, and at the same time providing a second spray force for assisting the first spray force using a physical spray module arranged in the chamber and opposite the nozzle to spray the fluid and form the liquid droplet.

Still another exemplary embodiment of the present invention provides a liquid droplet spray apparatus for spraying a liquid droplet on one side of a material to be printed, the liquid droplet spray apparatus including: a nozzle body which includes a chamber for containing a predetermined amount of fluid supplied from an exterior, and a nozzle communicating with the chamber and spraying a liquid droplet of the fluid contained in the chamber to one side of the material to be printed; an electrode module unit which is arranged to be attached to or spaced apart from an outside of the nozzle body; an alternating current signaler which applies an alternating current signal to the electrode module unit; and a signal control unit which controls intensity and frequency of an output signal from the alternating current signaler.

The electrode module unit may be arranged to surround the nozzle of the nozzle body.

The electrode module unit may include a first electrode unit arranged to be attached to or spaced apart from the outside of the nozzle body; and a second electrode unit arranged to be attached to or spaced apart from the outside of the nozzle body so as to be spaced apart from the first electrode unit.

The first electrode unit and the second electrode unit may be arranged to be symmetrical to each other with respect to the nozzle body.

The first electrode unit may be arranged to be spaced apart from one side of the nozzle body, and the second electrode unit may be arranged to be spaced apart from the other side of the nozzle body.

The first electrode unit may be arranged to form a pair as being respectively spaced apart at opposites sides of the outside of the nozzle body, and the second electrode unit is arranged to be attached to or spaced apart from the other side of the material to be printed.

The first electrode units may be integrally arranged to be respectively spaced apart from opposite sides of the outside of the nozzle body and the nozzle, and formed with a through hole via which a liquid droplet sprayed from the nozzle to one side of the material to be printed passes, and the second electrode unit is arranged to be attached to or spaced apart from the other side of the material to be printed.

The nozzle body may be formed as a flat plate type having a cross-section tapering toward the nozzle or a cylindrical type having a cross-section tapering toward the nozzle.

The first electrode unit and the second electrode unit may be stacked to each other with an insulating spacer therebetween, and the first and second electrode units stacked to each other are attached to an outer circumference of the nozzle.

The first electrode unit and the second electrode unit may be stacked to each other with an insulating spacer therebetween, and the first and second electrode units stacked to each other are arranged to be spaced apart from an outer circumference of the nozzle and formed with a through hole via which a liquid droplet sprayed from the nozzle to one side of the material to be printed passes.

The first electrode unit may be arranged to be spaced apart from one side of the nozzle body, and the second electrode unit may be formed with a through hole via which a liquid droplet sprayed from the nozzle to one side of the material to be printed passes and is arranged to be spaced apart from one side or the other side of the material to be printed.

The liquid droplet spraying apparatus may further include a pulse signal unit for supplying a pulse signal at a peak point of an alternating current signal supplied to the first electrode unit and the second electrode unit.

The nozzle bodies including the first and second electrode units may be arranged in plural neighboring to each other with insulating spacers therebetween, and the alternating current signal is applied to the first and second electrode units of each of the plural nozzle bodies arranged neighboring to each other.

The liquid droplet spraying apparatus may further include a plurality of pulse signal units for supplying a pulse signal at a peak point of an alternating current signal supplied to the first electrode unit and the second electrode unit of each nozzle body.

The nozzle of the nozzle body may include a conductive material.

The nozzle of the nozzle body may include a non-conductive material in which a conductive wire is embedded.

Still another exemplary embodiment of the present invention provides a liquid droplet spray method of spraying a liquid droplet to one side of a material to be printed, the liquid droplet spray method including: a) preparing a nozzle body which includes a chamber for containing a predetermined amount of fluid supplied from an exterior, and a nozzle communicating with the chamber and spraying a liquid droplet of the fluid contained in the chamber to one side of the material to be printed; b) arranging an electrode module unit to be attached to or spaced apart from one side of an outside of the nozzle body; and c) applying an alternating current signal to the electrode module unit.

Still another exemplary embodiment of the present invention provides a liquid droplet spray method of spraying a liquid droplet to one side of a material to be printed, the liquid droplet spray method including: a) preparing a nozzle body which includes a chamber for containing a predetermined amount of fluid supplied from an exterior, and a nozzle communicating with the chamber and spraying a liquid droplet of the fluid contained in the chamber to one side of the material to be printed; b) arranging an electrode module unit to be attached to or spaced apart from one side of an outside of the nozzle body; and c) applying an alternating current signal as a bias to the electrode module unit; and d) applying a pulse signal at a peak point of the alternating current signal to the electrode module unit.

Still another exemplary embodiment of the present invention provides a liquid droplet spray apparatus for spraying a liquid droplet to one side of a material to be printed, the liquid droplet spray apparatus including: a nozzle body which includes a chamber for containing a predetermined amount of fluid supplied from an exterior, and a nozzle communicating with the chamber and spraying a liquid droplet of the fluid contained in the chamber to one side of the material to be printed; a first electrode unit which is arranged inside the nozzle; a second electrode unit which is arranged to surround a lateral side of the nozzle as being spaced apart from the first electrode unit; an alternating current signaler which applies an alternating current signal between the first electrode unit and the second electrode unit; and a signal control unit which controls intensity and frequency of an output signal from the alternating current signaler.

The first electrode unit may be arranged coaxially with a center of the nozzle or coated on an inside of the nozzle.

The first electrode unit may be formed as the whole or a part of the nozzle.

The second electrode units may be equiangularly arranged in plural as being spaced apart from the nozzle body.

The second electrode units may be arranged in parallel as being spaced apart at opposite sides from the nozzle.

The liquid droplet spraying apparatus may further include a second' electrode unit provided in one side or the other side of the material to be printed and having the same electrical features as the second electrode unit so that an auxiliary spray force can be exerted to a liquid droplet sprayed from the nozzle.

The nozzle body may be formed as a flat plate type having a cross-section tapering toward the nozzle or a cylindrical type having a cross-section tapering toward the nozzle.

The liquid droplet spraying apparatus may further include a pulse signal unit for supplying a pulse signal at a peak point of an alternating current signal supplied to the first electrode unit and the second electrode unit.

The nozzle bodies including the first and second electrode units may be arranged in plural neighboring to each other with insulating spacers therebetween, and the alternating current signal may be individually applied to the first and second electrode units of each of the plural nozzle bodies arranged neighboring to each other.

The liquid droplet spraying apparatus may further include a plurality of pulse signal units for supplying a pulse signal at a peak point of an alternating current signal supplied to the first electrode unit and the second electrode unit of each nozzle body.

The alternating current signal applied between the first electrode unit and the second electrode unit may include a sine wave or a square wave.

Still another exemplary embodiment of the present invention provides a liquid droplet spray apparatus for spraying a liquid droplet to one side of a material to be printed, the liquid droplet spray apparatus including: a nozzle body which includes a chamber for containing a predetermined amount of fluid supplied from an exterior, and a nozzle communicating with the chamber and spraying a liquid droplet of the fluid contained in the chamber to one side of the material to be printed; a first electrode unit which is arranged inside the nozzle; an alternating current signaler which applies an alternating current signal to the first electrode unit; and a signal control unit which controls intensity and frequency of an output signal from the alternating current signaler.

The first electrode unit may be arranged coaxially with a center of the nozzle or coated on an inside of the nozzle.

The first electrode unit may be formed as the whole or a part of the nozzle.

The alternating current signal applied between the first electrode unit and the second electrode unit may include a sine wave or a square wave.

Still another exemplary embodiment of the present invention provides a liquid droplet spray method for spraying a liquid droplet to one side of a material to be printed, the liquid droplet spray method including: a) preparing a nozzle body which includes a chamber for containing a predetermined amount of fluid supplied from an exterior, and a nozzle communicating with the chamber and spraying a liquid droplet of the fluid contained in the chamber to one side of the material to be printed; b) arranging a first electrode unit inside the nozzle, and arranging a second electrode unit to surround a lateral side of the nozzle as being spaced apart from the first electrode unit; and c) applying an alternating current signal between the first electrode unit and the second electrode unit.

Still another exemplary embodiment of the present invention provides a liquid droplet spray method for spraying a liquid droplet to one side of a material to be printed, the liquid droplet spray method including: a) preparing a nozzle body which includes a chamber for containing a predetermined amount of fluid supplied from an exterior, and a nozzle communicating with the chamber and spraying a liquid droplet of the fluid contained in the chamber to one side of the material to be printed; b) arranging a first electrode unit inside the nozzle, and arranging a second electrode unit to surround a lateral side of the nozzle as being spaced apart from the first electrode unit; c) applying an alternating current signal as a bias between the first electrode unit and the second electrode unit; and d) applying a pulse signal between the first electrode unit and the second electrode unit at a peak point of the alternating current signal.

The alternating current signal applied between the first electrode unit and the second electrode unit may include a sine wave or a square wave.

Still another exemplary embodiment of the present invention provides a liquid droplet spray method for spraying a liquid droplet to one side of a material to be printed, the liquid droplet spray method including: a) preparing a nozzle body which includes a chamber for containing a predetermined amount of fluid supplied from an exterior, and a nozzle communicating with the chamber and spraying a liquid droplet of the fluid contained in the chamber to one side of the material to be printed; b) arranging a first electrode unit inside the nozzle; and c) applying an alternating current signal to the first electrode unit.

The alternating current signal applied between the first electrode unit and the second electrode unit may include a sine wave or a square wave.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF THE EMBODIMENTS

The present invention will be apparent through exemplary embodiments to be described later with reference to accompanying drawings. Below, detailed descriptions will be given so that those skilled in the art can easily understand and realize the exemplary embodiments of the present invention.

Figure 1:
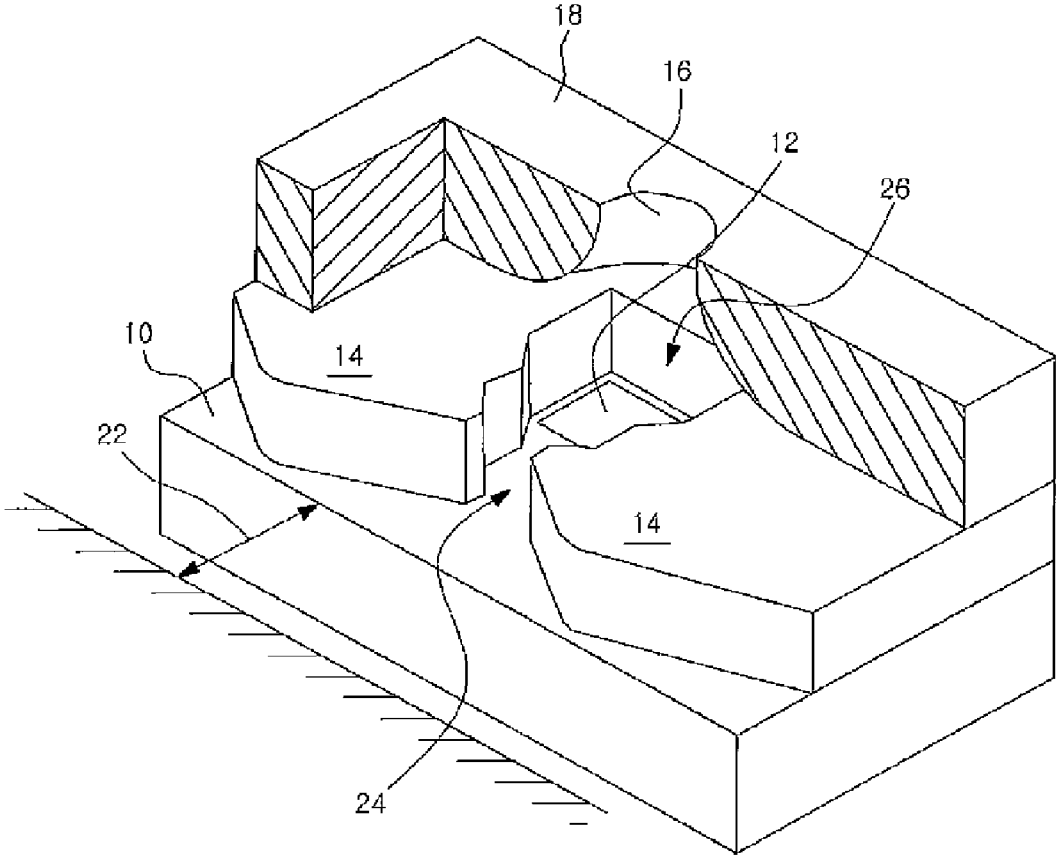
FIGS. 1 and 2 show an example of a conventional thermal driving type liquid droplet spraying apparatus.
Figure 2:
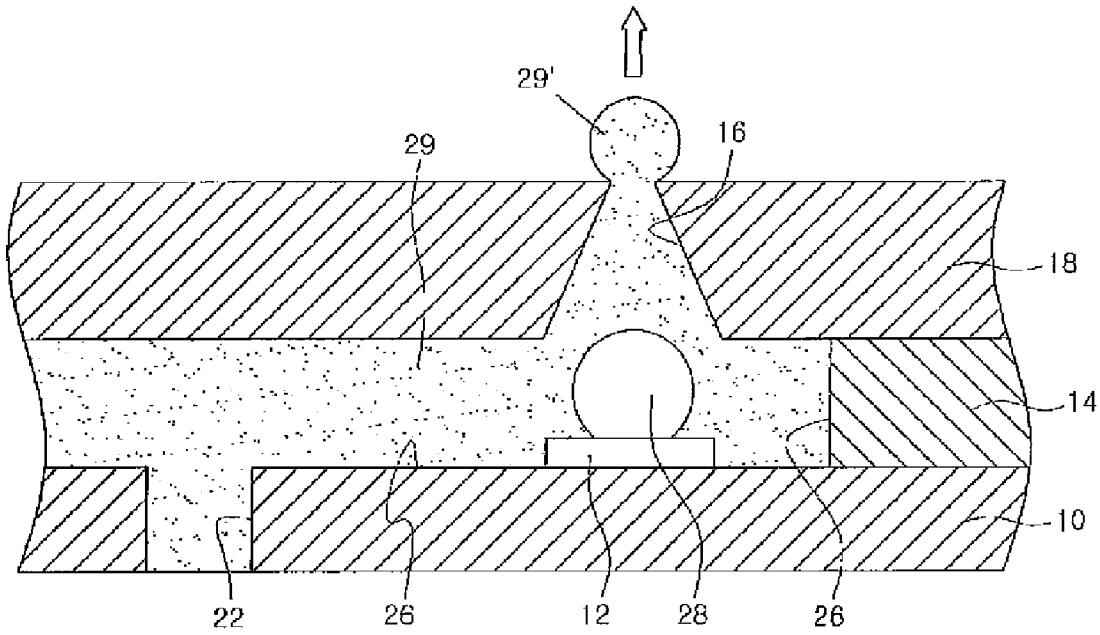
Figure 3:
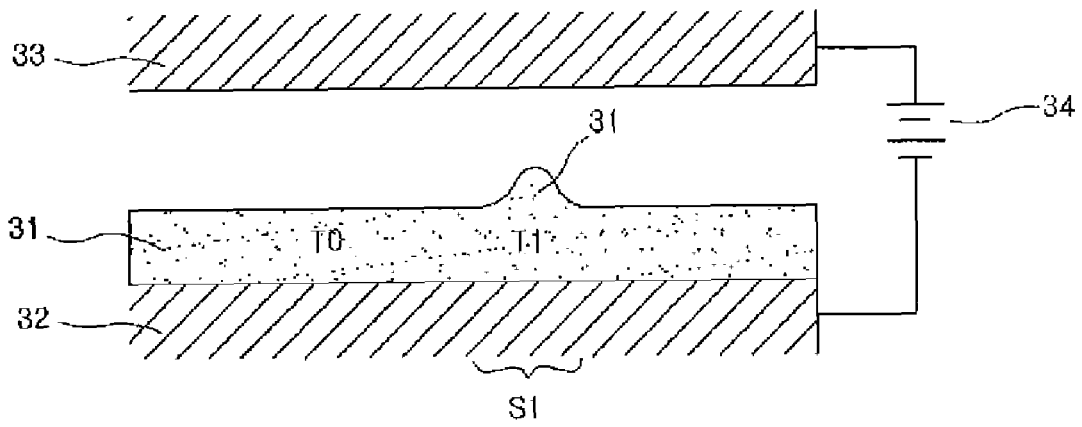
FIGS. 3 and 4 show an example of a conventional electrostatic type liquid droplet spraying apparatus.
Figure 4:
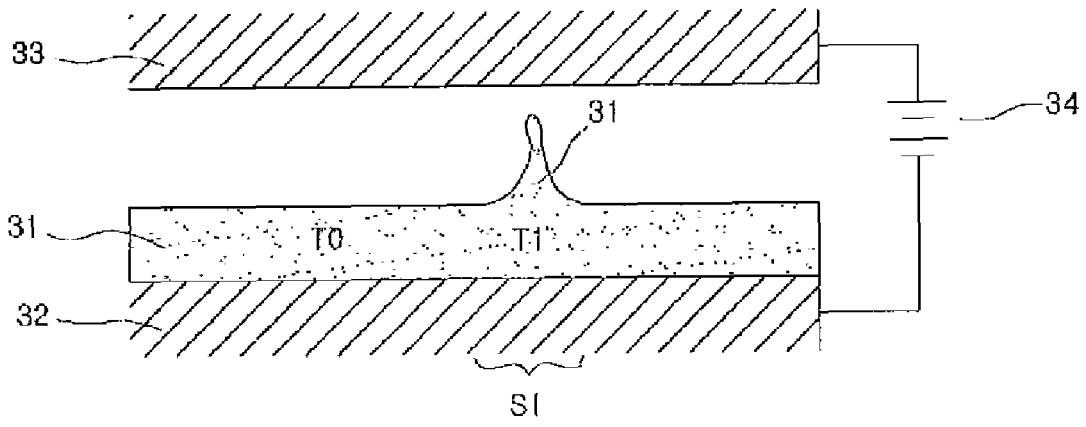
Figure 5:
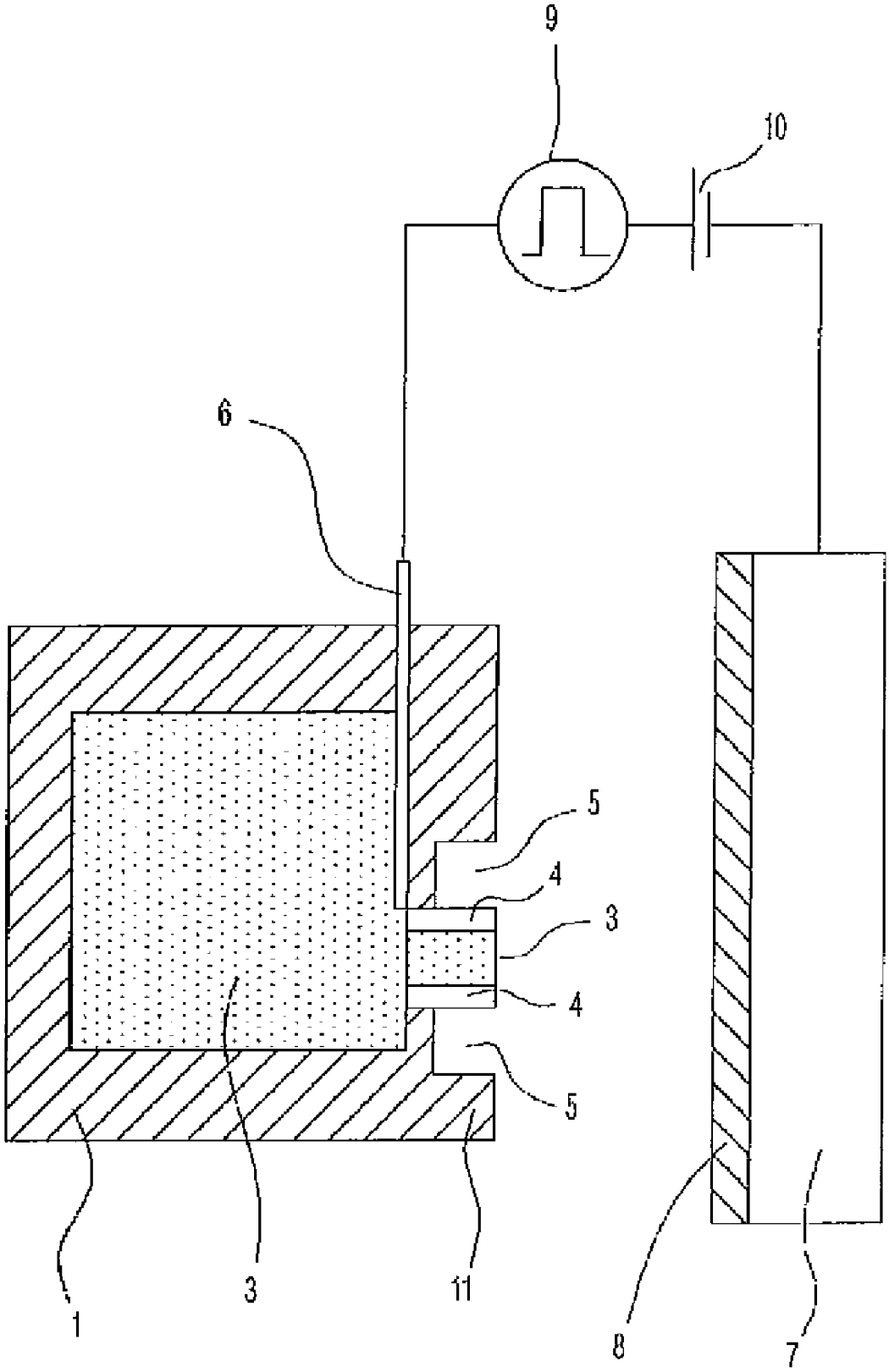
FIG. 5 is a view for explaining a conventional electrostatic type ink spraying method.
Figure 6:
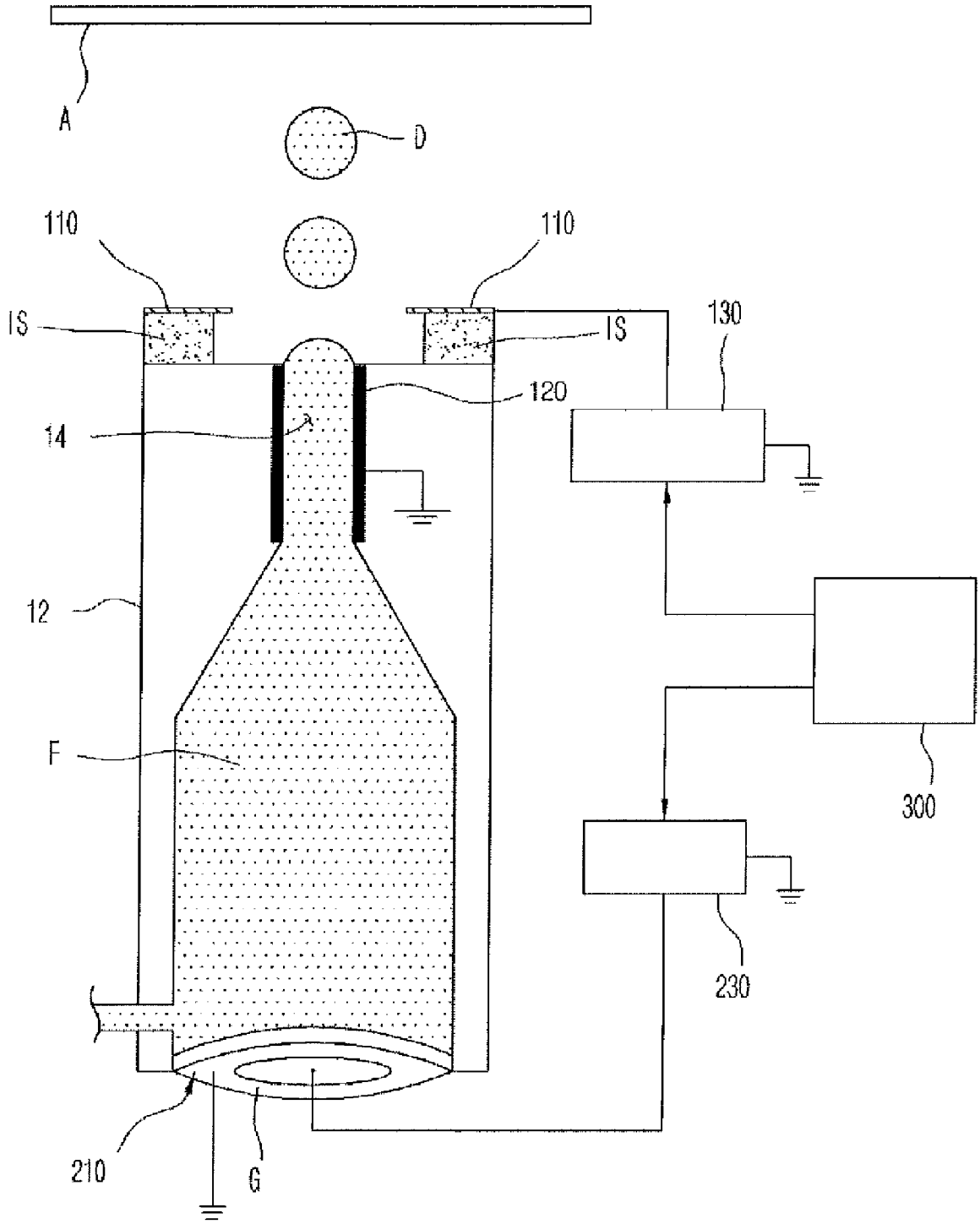
FIG. 6 is a cross-section view schematically showing a liquid droplet spraying apparatus according to a first exemplary embodiment of the present invention.

As shown in FIG. 6, a liquid droplet spraying apparatus according to an exemplary embodiment of the present invention having a chamber 12 containing fluid F, and a nozzle body having a nozzle 14 for spraying the fluid F contained in the chamber 12 toward one side surface of a material to be printed includes an electrostatic spray module, a physical spray module and a control unit 300 for controlling them.

The nozzle 14 of the nozzle body may include a conductive material, or a non-conductive material in which a conductive wire is embedded. If the nozzle 14 is configured to be wholly made of the conductive material or to be partially embedded with the conductive wire, there is an advantage of increasing jetting efficiency. This is because an electric current induced by an external electrostatic force may be generated in the conductive material and thus the electrostatic force may be more strongly exerted to the fluid F.

Below, the electrostatic spray module will be described.

As shown in FIG. 6, the electrostatic spray module is arranged in the vicinity of the chamber 12 or the nozzle 14, and provides a first spray force to form an electrostatic field in the fluid F contained in the chamber 12 and spray the fluid F through the nozzle 14, thereby forming a liquid droplet D.

Referring to FIG. 6, the electrostatic spray module may be configured to include an electrode module unit 110 arranged to be spaced apart from the nozzle 14, a second electrode module unit 120 arranged in an inside of the nozzle 14, and an alternating current signaler 130 for applying an alternating current signal to the electrode module unit 110 and the second electrode unit 120.

With the foregoing configuration, an electrostatic field may be formed on the surface of the fluid F as an alternating current signal is applied to the electrode module unit 110 arranged to face the material to be printed A and be spaced from the nozzle 14. At this time, the alternating current signal is an alternating sine wave signal.

Specifically, the alternating current signal is a sine wave signal that repetitively alternates between (+) and (−). When an alternating current signal of (+) is applied to the electrode module, the fluid F induced by (−) electrical charges is concentrated on a liquid surface of the nozzle 14, so that a liquid droplet D possessing the (−) electrical charges can be sprayed to the material to be printed A. On the other hand, when an alternating current signal of (−) is applied to the electrode module, the fluid F induced by (+) electrical charges is concentrated on a liquid surface of the nozzle 14, so that a liquid droplet D possessing the (+) electrical charges can be sprayed to the material to be printed A.

At this time, the liquid droplet D sprayed to the surface of the material to be printed A is prevented from rebounding and effectively arrives onto the surface of the material to be printed A since the liquid droplet D possessing the (−) electrical charges and the liquid droplet D possessing the (+) electrical charges are sequentially and alternately seated.

Thus, the electrostatic spray module provides the first spray force so that the electrostatic field can be formed in the fluid F contained in the chamber 12, and the fluid F can be sprayed through the nozzle 14.

Below, the physical spray module will be described.

Figure 10:
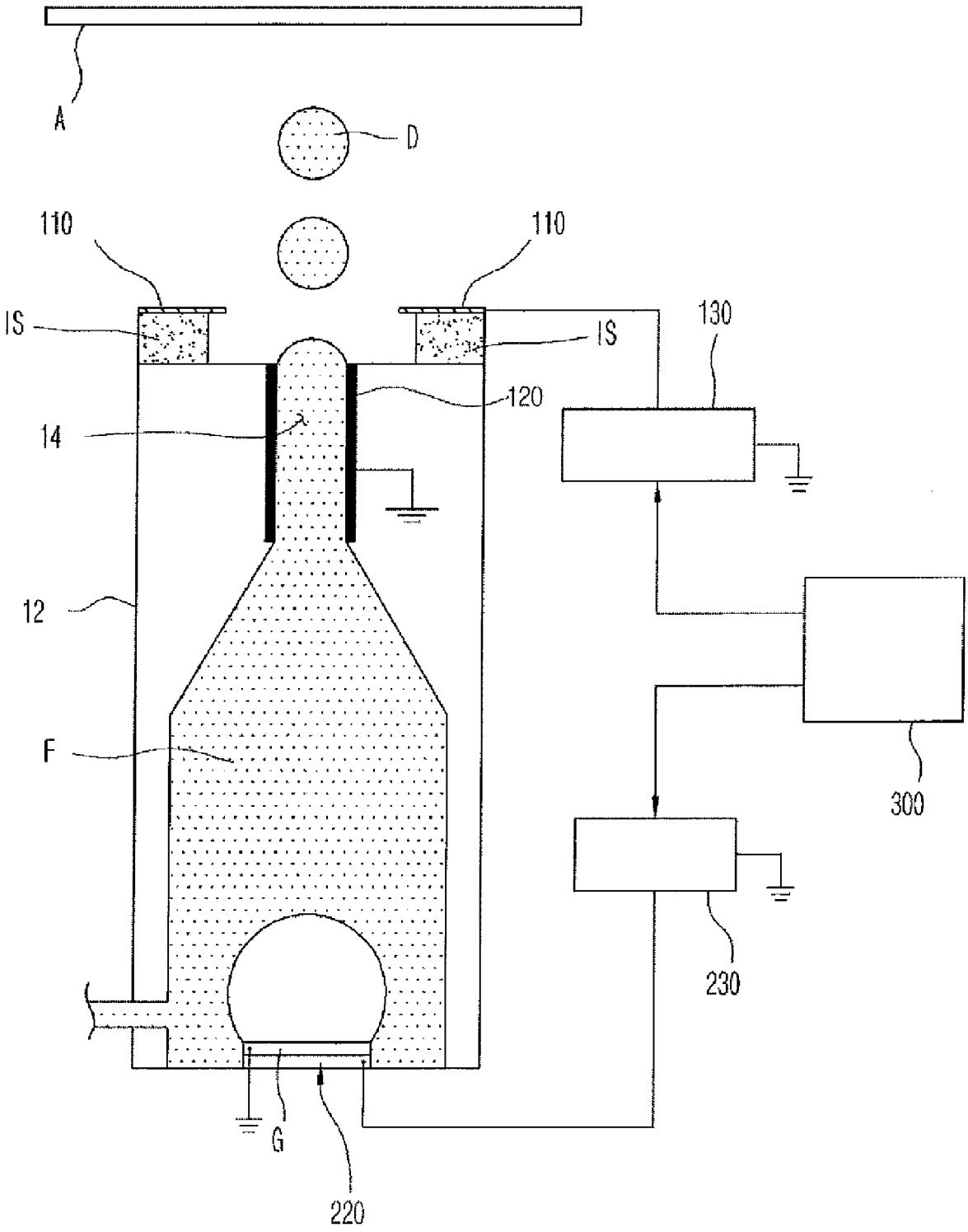
FIG. 10 is a cross-section view schematically showing a liquid droplet spraying apparatus according to a fourth exemplary embodiment of the present invention.

As shown in FIGS. 6 and 10, the physical spray module is opposite to the nozzle 14 and provided inside the chamber 12, and generates a second spray force assisting the first spray force when the first spray force is generated.

The physical spray module may be configured to include a piezoelectric operator 210 and a driving signaler 230 for applying a driving signal to the piezoelectric operator 210 as shown in FIG. 6, or include a heating operator 220 and a driving signaler 230 for applying a driving signal to the heating operator 220 as shown in FIG. 10.

With the foregoing configuration, the piezoelectric operator 210 or the heating operator 220 selectively applies pressure to the fluid F contained in the chamber 12 in accordance with the driving signal of the driving signaler 230 provided inside the chamber 12, i.e., an inner opposite surface of the chamber 12 opposite the nozzle 14, thereby providing the second spray force. At this time, the second spray force assists the first spray force generated by the electrostatic module. Such relationship between the first spray force and the second spray force will be described together with interaction between the electrostatic spray module and the physical spray module.

Thus, the physical spray module selectively applies pressure to the fluid F contained in the chamber 12 to thereby provide the second spray force, and the second spray force assists the first spray force generated by the electrostatic spray module.

Next, the interaction between the electrostatic spray module and the physical spray module will be described.

As described above, the electrostatic spray module forms the electrostatic field in the fluid F contained in the chamber 12 and provides the first spray force based on the electrostatic filed. The physical spray module selectively applies pressure to the fluid F contained in the chamber 12 and provides the second spray force. Here, the control unit 300 controls the second spray force to assist the first spray force only when the first spray force is generated. That is, the control unit 300 controls the electrostatic spray module and the physical spray module so that the first and second spray forces can be provided by a certain pattern.

Figure 13:
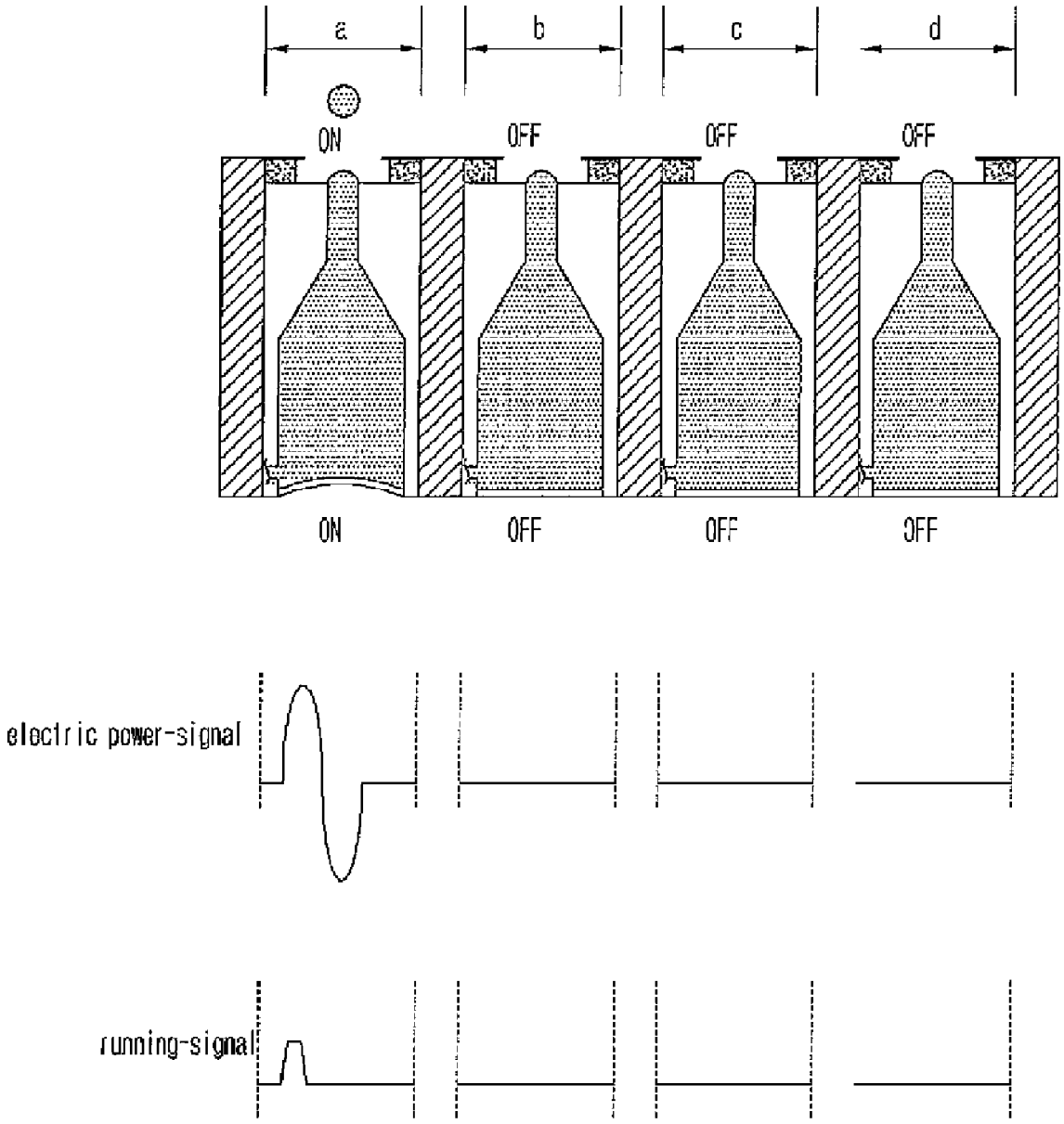
FIGS. 13 to 15 are operational views showing that a plurality of liquid droplet spraying apparatuses according to an exemplary embodiment of the present invention operates in the state that they are arranged neighboring to each other.

Referring to FIGS. 6, 10 and 13, as the alternating current signal is applied from the alternating current signaler 130 to the electrode module unit 110 as shown in "a" of FIG. 13 and at the same time a driving signal is applied from the driving signaler 230 to the piezoelectric operator 210 or heating operator 220 of the physical spray module, the first spray force generated by the electrostatic spray module and the second spray force generated by the physical spray module are simultaneously provided in "a" of FIG. 13, thereby discharging the liquid droplet D.

Figure 14:
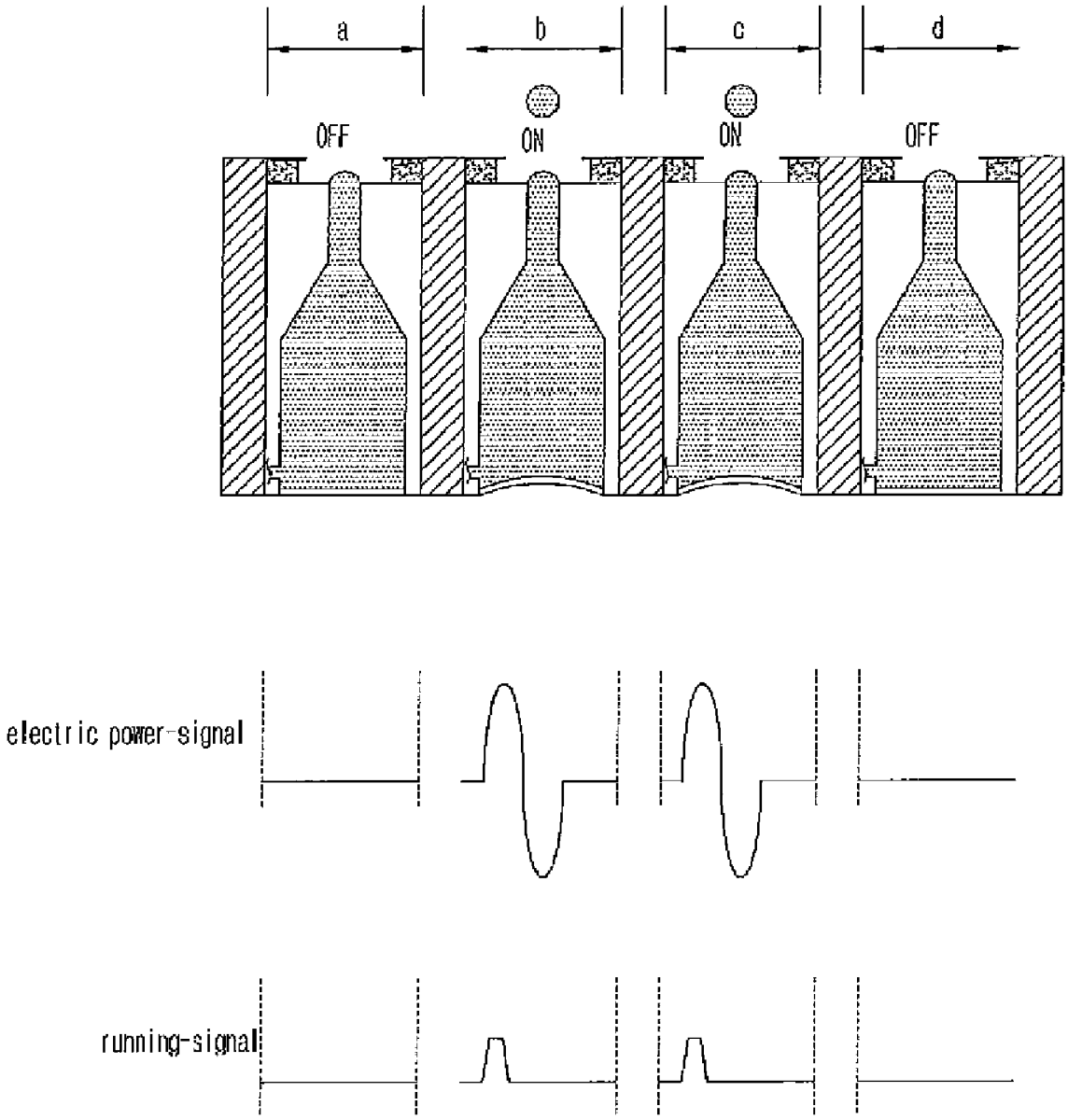

Also, as shown in "b" and "c" of FIG. 14, as the alternating current signal is applied from the alternating current signaler 130 to the electrode module unit 110 and at the same time a driving signal is applied from the driving signaler 230 to the piezoelectric operator 210 or heating operator 220 of the physical spray module, the first spray force generated by the electrostatic spray module and the second spray force generated by the physical spray module are simultaneously provided in "b" and "c" of FIG. 14, thereby discharging the liquid droplet D.

Figure 15:
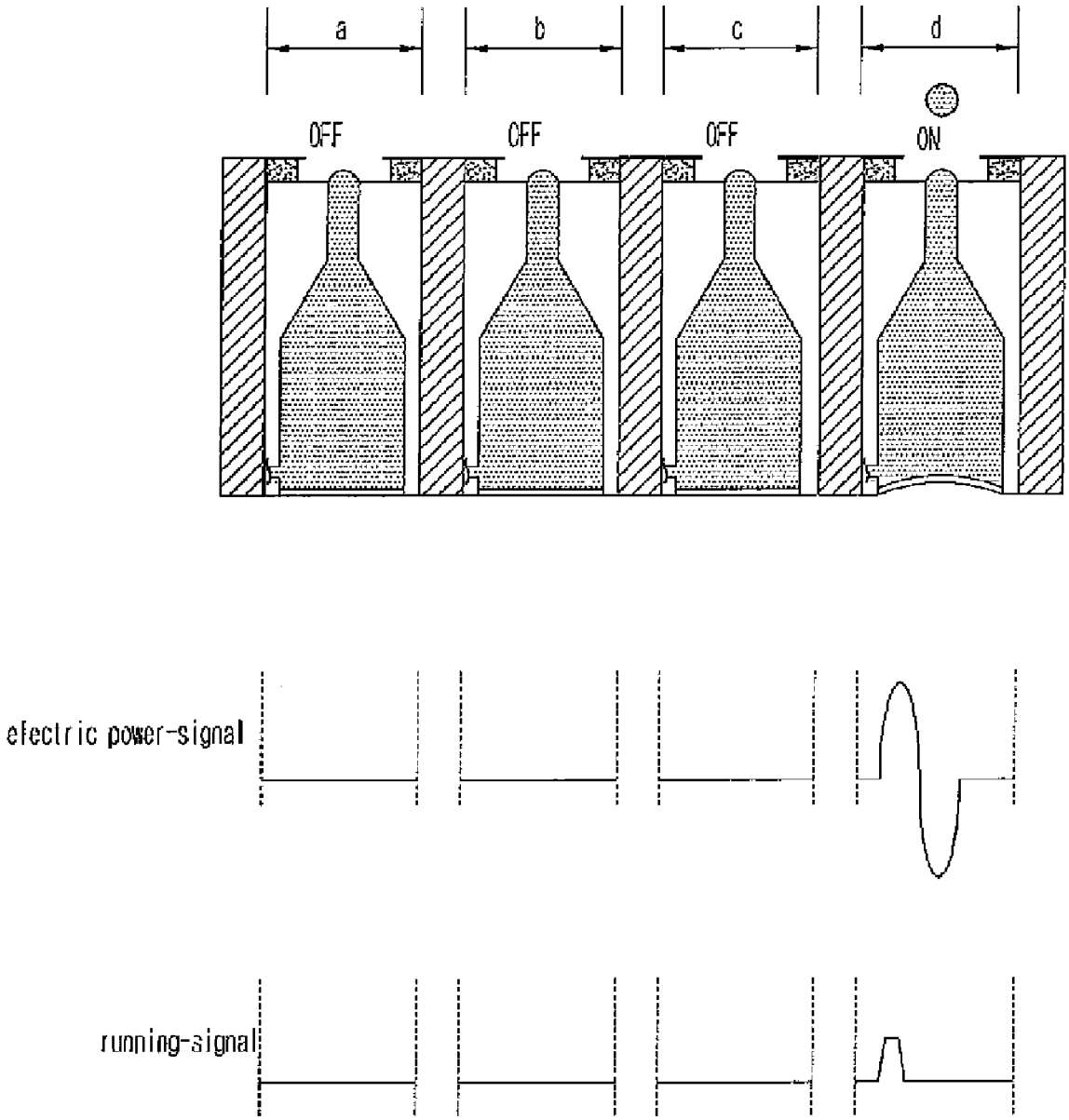

Further, as shown in "d" of FIG. 15, as the alternating current signal is applied from the alternating current signaler 130 to the electrode module unit 110 and at the same time a driving signal is applied from the driving signaler 230 to the piezoelectric operator 210 or heating operator 220 of the physical spray module, the first spray force generated by the electrostatic spray module and the second spray force generated by the physical spray module are simultaneously provided in "d" of FIG. 15, thereby discharging the liquid droplet D.

As described above, at a point of time when the liquid droplet D is desired to be sprayed through the nozzle 14 of the nozzle body, the first spray force is provided by the electrostatic spray module forming the electrostatic field in the fluid F and at the same time the second spray force assisting the first spray module is provided by the physical spray module selectively applying pressure to the fluid F, so that the liquid droplet D sprayed through the nozzle 14 can be improved in a spray force.

Hereinafter, various exemplary embodiments of the present invention configured and interacting as described above will be described.

First Exemplary Embodiment with Reference to FIG. 6

In a liquid droplet spraying apparatus according to the first exemplary embodiment, the electrostatic spray module may be configured to include an electrode module unit 110 arranged to be spaced apart from the nozzle 14, and an alternating current signaler 130 for applying an alternating current signal to the electrode module unit 110, and the physical spray module may be configured to include a piezoelectric operator 210 and a driving signaler 230 for applying a driving signal to the piezoelectric operator 210. Here, the alternating current signal may be an alternating sine wave signal.

With the configuration as described above, as the driving signal is applied from the driving signaler 230 to the piezoelectric operator 210 at a time when the alternating current signal is applied from the alternating current signaler 130 to the electrode module unit 110, the first spray force based on the electrostatic force formed by the alternating current signal applied to the electrode module unit 110 and the second spray force based on the pressure of the piezoelectric operator 210 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

Figure 7:
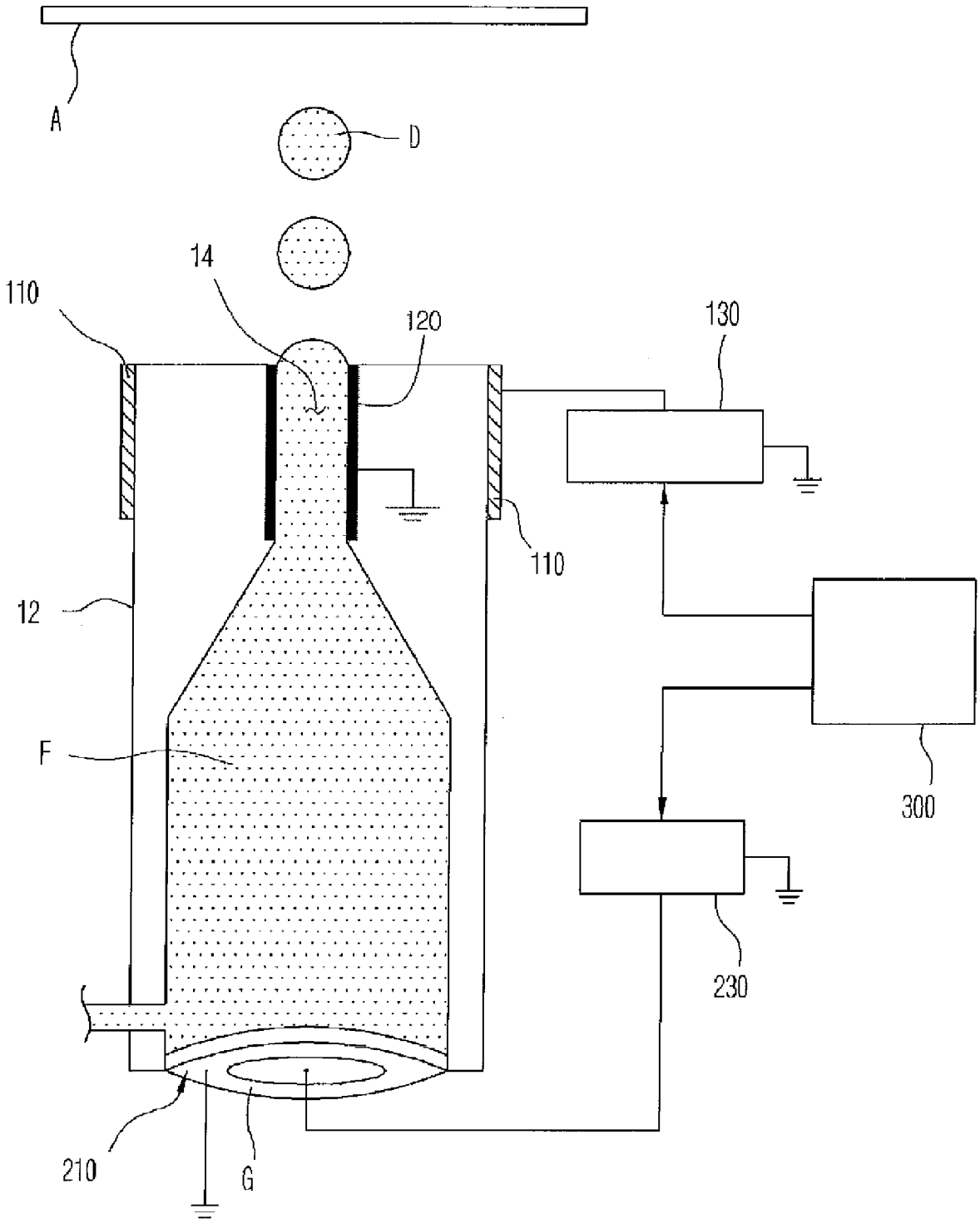
FIG. 7 is a cross-section view schematically showing another liquid droplet spraying apparatus according to the first exemplary embodiment of the present invention.

According to an alternative form of the first exemplary embodiment, as shown in FIG. 7, the electrode module units 110 may be arranged to be spaced apart at opposite sides of the nozzle. Meanwhile, a second electrode module unit 120 is arranged in an inside of the nozzle 14. Like the exemplary embodiment shown in FIG. 6, the driving signal is applied from the driving signaler 230 to the piezoelectric operator 210 at a point of time when the alternating current signal is applied from the alternating current signaler 130 to the electrode module unit 110 and the second electrode unit 120, so that the first spray force based on the electrostatic force formed by the alternating current signal applied to the electrode module 110 and the second spray force based on the pressure of the piezoelectric operator 210 can operate simultaneously to thereby spray the liquid droplet D.

Figure 8:
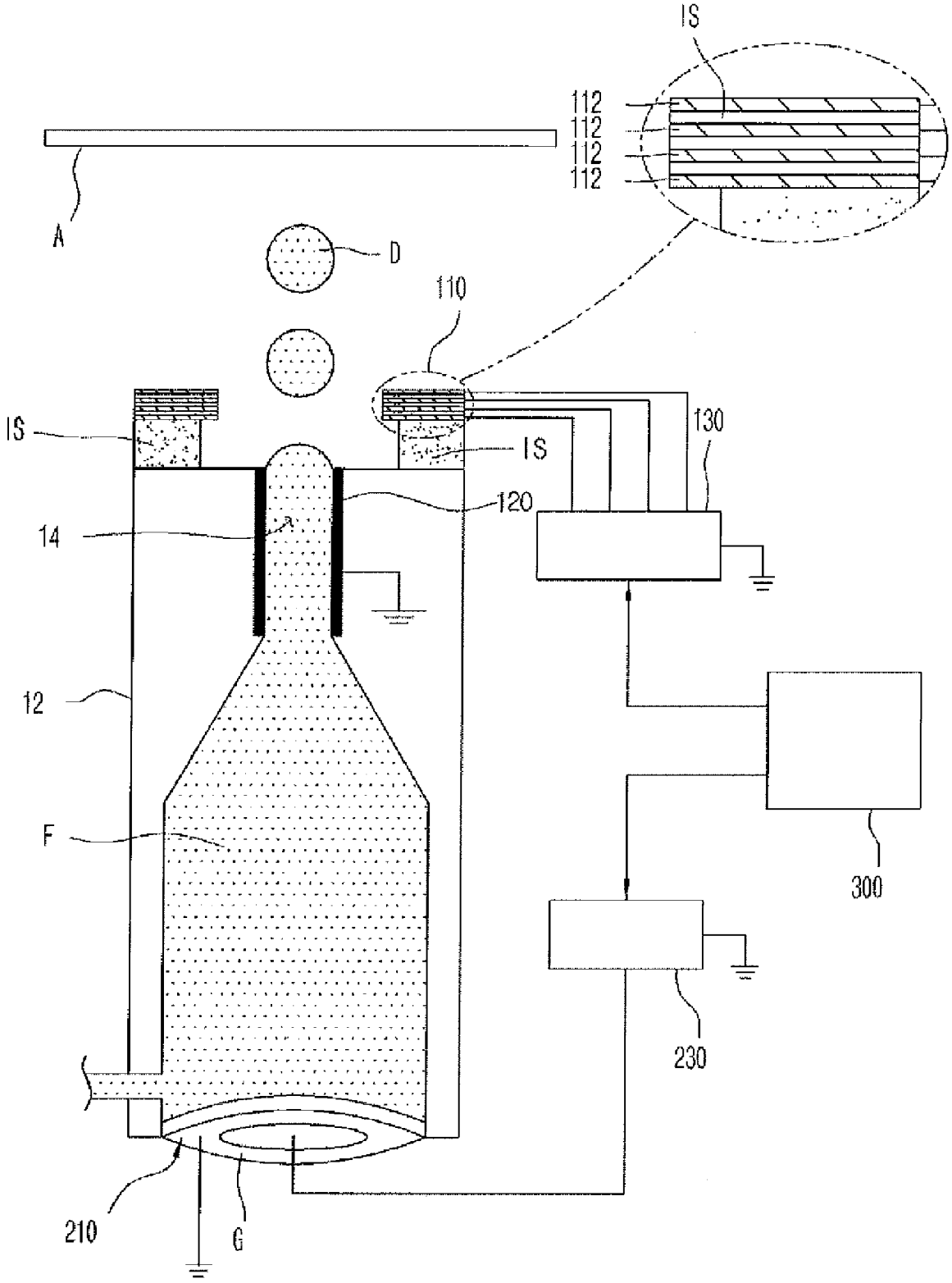
FIG. 8 is a cross-section view schematically showing a liquid droplet spraying apparatus according to a second exemplary embodiment of the present invention.

Second Exemplary Embodiment with Reference to FIG. 8

In a liquid droplet spraying apparatus according to the second exemplary embodiment, the electrostatic spray module may be configured to include an electrode module unit 110 with a plurality of stack modules 112 arranged to be spaced apart from the nozzle 14 and stacked spaced apart from each other, a second electrode module unit 120 arranged in an inside of the nozzle 14, and an alternating current signaler 130 for applying an alternating current signal to the plurality of stack modules 112 of the electrode module unit 110 and the second electrode unit 120, and the physical spray module may be configured to include a piezoelectric operator 210 and a driving signaler 230 for applying a driving signal to the piezoelectric operator 210. Here, the alternating current signal may be an alternating sine wave signal.

With the configuration as described above, as the driving signal is applied from the driving signaler 230 to the piezoelectric operator 210 at a time when the alternating current signal is applied from the alternating current signaler 130 to the plurality of stack modules 112 of the electrode module unit 110, the first spray force based on the electrostatic force formed by the alternating current signal applied to the plurality of stack modules 112 of the electrode module unit 110 and the second spray force based on the pressure of the piezoelectric operator 210 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

In light of applying the alternating current signal to the plurality of stack modules 112 of the electrode module unit, the intensity of the alternating current signals applied to the respective stack modules 112 may be controlled individually.

As described above, if the intensity of the alternating current signal applied to each stack module 112 is individually controlled, it is possible to control the speed of the sprayed liquid droplet D.

Figure 9:
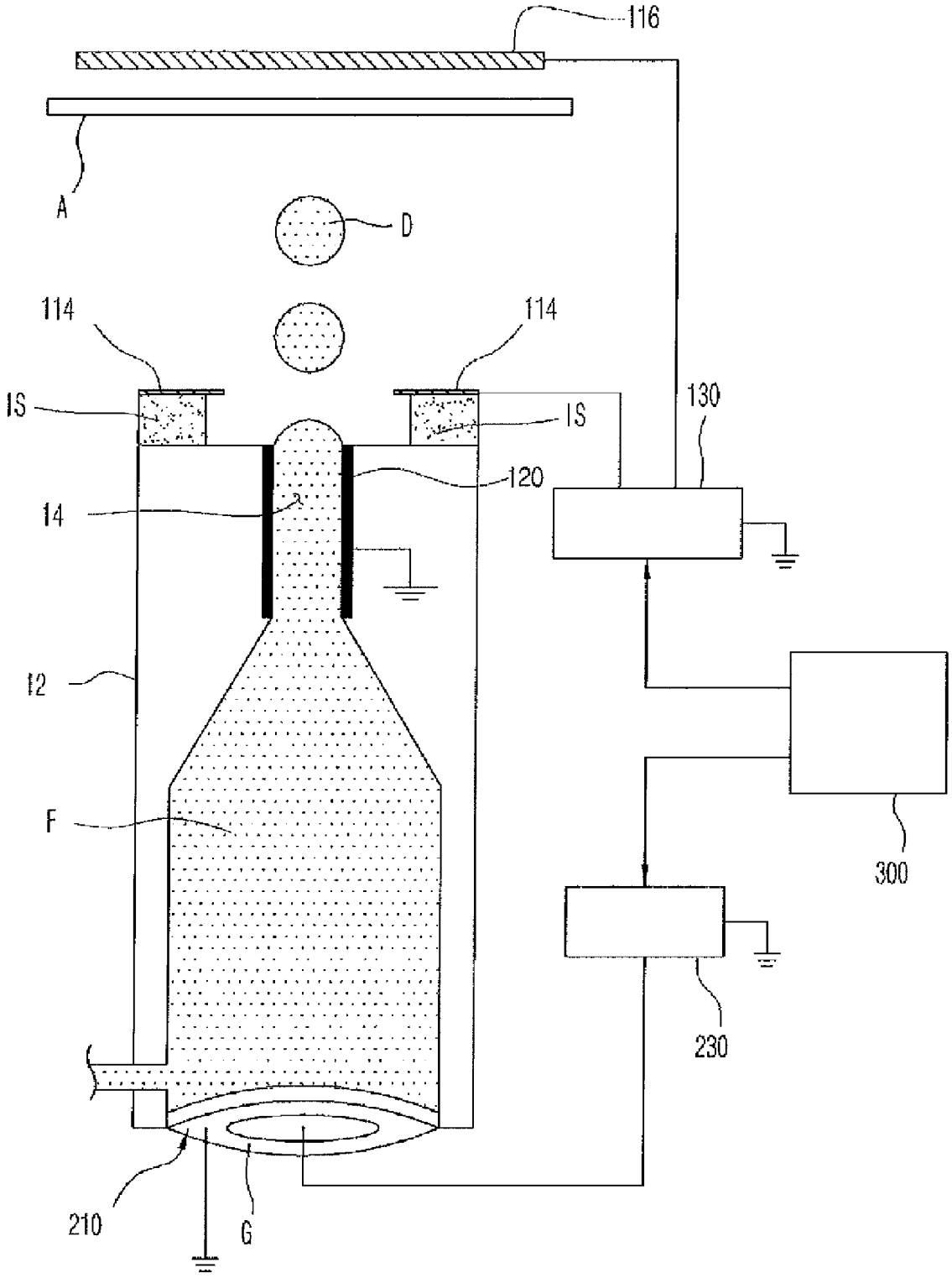
FIG. 9 is a cross-section view schematically showing a liquid droplet spraying apparatus according to a third exemplary embodiment of the present invention.

Third Exemplary Embodiment with Reference to FIG. 9

In a liquid droplet spraying apparatus according to the third exemplary embodiment, the electrostatic spray module may be configured to include an electrode module unit 110 with a front module 114 arranged to be spaced apart from the nozzle 14 and a rear module 116 arranged to be attached to or spaced apart from the other surface of the material to be printed A, a second electrode module unit 120 arranged in an inside of the nozzle 14, and an alternating current signaler 130 for applying an alternating current signal to the electrode module unit 110 having the front module 114 and the rear module 116 and the second electrode unit 120, and the physical spray module may be configured to include a piezoelectric operator 210 and a driving signaler 230 for applying a driving signal to the piezoelectric operator 210. Here, the alternating current signal may be an alternating sine wave signal.

With the configuration as described above, as the driving signal is applied from the driving signaler 230 to the piezoelectric operator 210 at a time when the alternating current signal is applied from the alternating current signaler 130 to the front module 114 and the rear module 116 of the electrode module unit 110, the first spray force based on the electrostatic force formed by the alternating current signal applied to the front module 114 and the rear module 116 of the electrode module unit 110 and the second spray force based on the pressure of the piezoelectric operator 210 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

In light of applying the alternating current signal to the front module 114 and the rear module 116 of the electrode module unit 110, the intensity of the alternating current signals applied to the respective stack modules 112 may be controlled individually.

As described above, if the intensity of the alternating current signals applied to the front module 114 and the rear module 116 are individually controlled, it is possible to control the sprayed liquid droplet D to more stably arrive onto the material to be printed A.

Fourth Exemplary Embodiment with Reference to FIG. 10

In a liquid droplet spraying apparatus according to the fourth exemplary embodiment, the electrostatic spray module may be configured to include an electrode module unit 110 arranged to be spaced apart from the nozzle 14, a second electrode module unit 120 arranged in an inside of the nozzle 14, and an alternating current signaler 130 for applying an alternating current signal to the electrode module unit 110 and the second electrode unit 120, and the physical spray module may be configured to include a heating operator 220 and a driving signaler 230 for applying a driving signal to the heating operator 220. Here, the alternating current signal may be an alternating sine wave signal.

With the configuration as described above, as the driving signal is applied from the driving signaler 230 to the heating operator 220 at a time when the alternating current signal is applied from the alternating current signaler 130 to the electrode module unit 110, the first spray force based on the electrostatic force formed by the alternating current signal applied to the electrode module unit 110 and the second spray force based on the pressure due to heating of the heating operator 220 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

Figure 11:
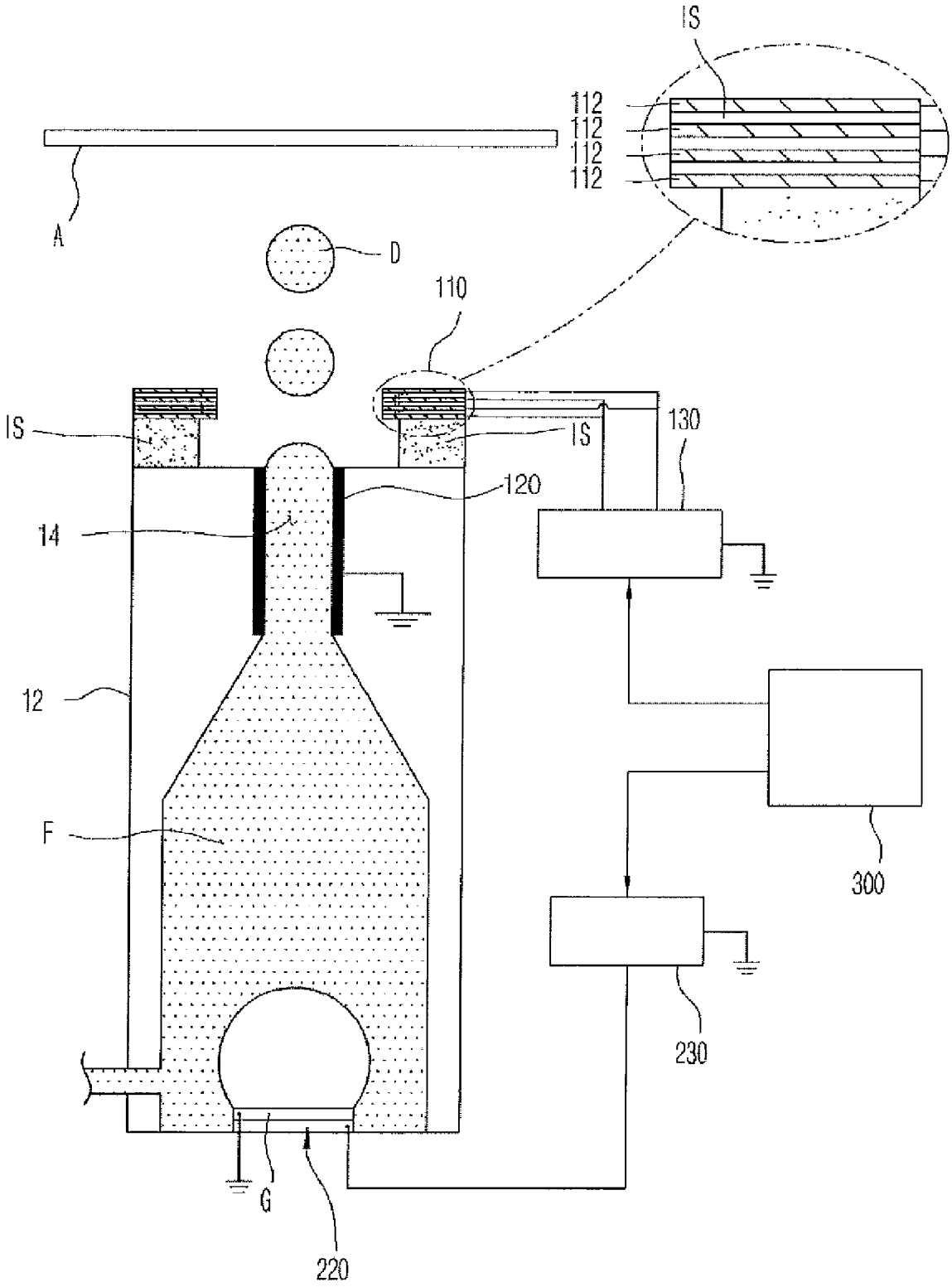
FIG. 11 is a cross-section view schematically showing a liquid droplet spraying apparatus according to a fifth exemplary embodiment of the present invention.

Fifth Exemplary Embodiment with Reference to FIG. 11

In a liquid droplet spraying apparatus according to the second exemplary embodiment, the electrostatic spray module may be configured to include an electrode module unit 110 with a plurality of stack modules 112 arranged to be spaced apart from the nozzle 14 and stacked spaced apart from each other, a second electrode module unit 120 arranged in an inside of the nozzle 14, and an alternating current signaler 130 for applying an alternating current signal to the plurality of stack modules 112 of the electrode module unit 110 and the second electrode unit 120, and the physical spray module may be configured to include a heating operator 220 and a driving signaler 230 for applying a driving signal to the heating operator 220. Here, the alternating current signal may be an alternating sine wave signal.

With the configuration as described above, as the driving signal is applied from the driving signaler 230 to the heating operator 220 at a time when the alternating current signal is applied from the alternating current signaler 130 to the plurality of stack modules 112 of the electrode module unit 110, the first spray force based on the electrostatic force formed by the alternating current signal applied to the plurality of stack modules 112 of the electrode module unit 110 and the second spray force based on the pressure due to heating of the heating operator 220 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

In light of applying the alternating current signal to the plurality of stack modules 112 of the electrode module unit, the intensity of the alternating current signals applied to the respective stack modules 112 may be controlled individually.

As described above, if the intensity of the alternating current signal applied to each stack module 112 is individually controlled, it is possible to control the speed of the sprayed liquid droplet D.

Figure 12:
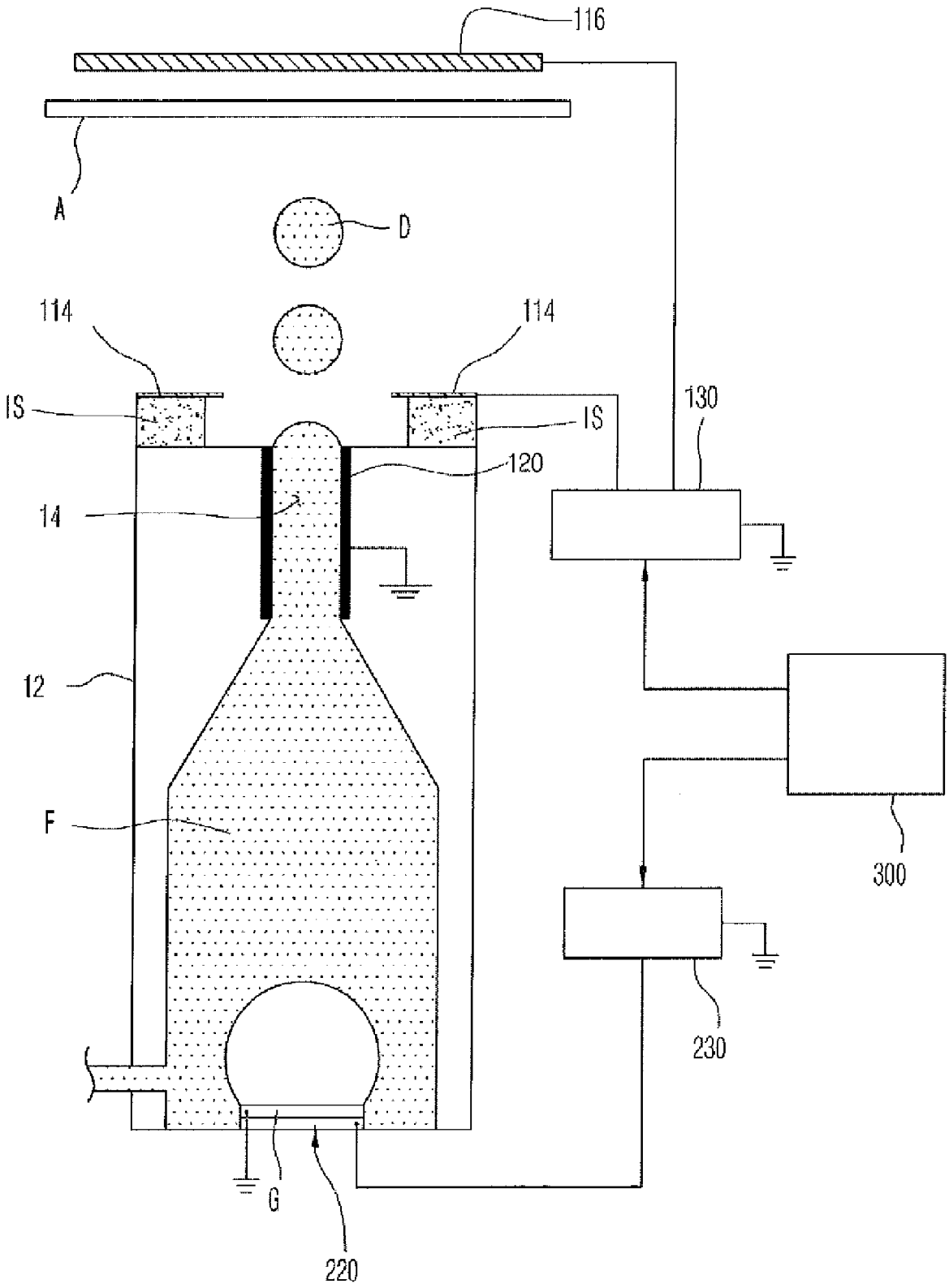
FIG. 12 is a cross-section view schematically showing a liquid droplet spraying apparatus according to a sixth exemplary embodiment of the present invention.

Sixth Exemplary Embodiment with Reference to FIG. 12

In a liquid droplet spraying apparatus according to the third exemplary embodiment, the electrostatic spray module may be configured to include an electrode module unit 110 with a front module 114 arranged to be spaced apart from the nozzle 14 and a rear module 116 arranged to be attached to or spaced apart from the other surface of the material to be printed A, a second electrode module unit 120 arranged in an inside of the nozzle 14, and an alternating current signaler 130 for applying an alternating current signal to the electrode module unit 110 having the front module 114 and the rear module 116 and the second electrode unit 120, and the physical spray module may be configured to include a heating operator 220 and a driving signaler 230 for applying a driving signal to the heating operator 220. Here, the alternating current signal may be an alternating sine wave signal.

With the configuration as described above, as the driving signal is applied from the driving signaler 230 to the heating operator 220 at a time when the alternating current signal is applied from the alternating current signaler 130 to the front module 114 and the rear module 116 of the electrode module unit 110, the first spray force based on the electrostatic force formed by the alternating current signal applied to the front module 114 and the rear module 116 of the electrode module unit 110 and the second spray force based on the pressure of the heating operator 220 are simultaneously exerted to thus spray the liquid droplet D.

Meanwhile, the control unit 300 controls the alternating current signal of the alternating current signaler 130– and the driving signal of the driving signaler 230, and more particularly controls the driving signaler 230 to generate the driving signal when the alternating current signaler 130 generates the alternating current signal.

In light of applying the alternating current signal to the front module 114 and the rear module 116 of the electrode module unit 110, the intensity of the alternating current signals applied to the respective stack modules 112 may be controlled individually.

As described above, if the intensity of the alternating current signals applied to the front module 114 and the rear module 116 are individually controlled, it is possible to control the sprayed liquid droplet D to more stably arrive onto the material to be printed A.

Next, a structure where a plurality of liquid droplet spraying apparatuses configured and operating as described above are arranged neighboring to each other according to an exemplary embodiment of the present invention will be described.

A structure where a plurality of nozzle bodies are integrated and arranged may be, as shown in FIGS. 13 to 15, achieved by interposing insulating spacers (IS) between the nozzle bodies 100 (refer to FIG. 6 for the nozzle body).

Referring to FIG. 13, a first nozzle body (a), a second nozzle body (b), a third nozzle body (c) and a fourth nozzle body (d) are arranged neighboring to each other in sequence from the right side of FIG. 13, and the first to fourth nozzle bodies are respectively provided with the electrode module units 110 arranged to be spaced apart from the respective nozzles 14. Meanwhile, the insulating spacers IS are respectively interposed between the first to fourth nozzle bodies.

Each electrode module unit 110 is connected to the alternating current signaler 130 and receives the alternating current signal. At this time, the received alternating current signal is as shown in FIG. 13.

Thus, the driving signal is applied from the driving signaler 230 at a point of time when the alternating current signal is applied from the alternating current signaler 130 to the electrode module unit 110 provided in the first nozzle body a, so that the liquid droplet D can be sprayed from the nozzle 14 of the first nozzle body a.

Also, as shown in FIG. 14, the driving signal is applied from the driving signaler 230 at a point of time when the alternating current signals are applied from the alternating current signaler 130 to the electrode module units 110 provided in the second nozzle body b and the third nozzle body c, so that the liquid droplet D can be sprayed from the nozzles 14 of the second nozzle body b and the third nozzle body c.

Further, as shown in FIG. 15, the driving signal is applied from the driving signaler 230 at a point of time when the alternating current signal is applied from the alternating current signaler 130 to the electrode module unit 110 provided in the fourth nozzle body d, so that the liquid droplet D can be sprayed from the nozzle 14 of the fourth nozzle body d.

Below, a method of spraying the liquid droplet D will be described.

According to an exemplary embodiment, in the method of spraying the liquid droplet D through the liquid droplet spraying apparatus provided with the chamber 12 containing the fluid F, and the nozzle body having the nozzle 14 for spraying the fluid F contained in the chamber 12 toward one side surface of the material to be printed A, the electrostatic spray module arranged in the vicinity of the chamber 12 or the nozzle 14 is used to form the electrostatic field in the fluid F contained in the chamber 12, and provide the first spray force so that the fluid F can be sprayed through the nozzle 14 to form the liquid drop D, and at the same time the physical spray module opposite to the nozzle 14 and provided in the chamber 12 is used to provide the second spray force assisting the first spray force to spray the fluid F, thereby forming the liquid drop D.

That is, as shown in FIGS. 13 to 15, the electrostatic spray module forms the electrostatic filed in the fluid F in accordance with the alternating current signal and provides the first spray force for spraying the liquid droplet D, and at the same time the physical spray module provides the second spray force for spraying the liquid droplet D as the piezoelectric operator 210 or the heating operator 220 applies pressure to the fluid F.

At this time, the second spray force of the physical spray module is provided only when the first spray force of the electrostatic spray module is provided.

Meanwhile, in the liquid droplet spraying apparatus and method as described above, the configuration and spray method of the electrostatic spray nozzle will be described.

Figure 16:
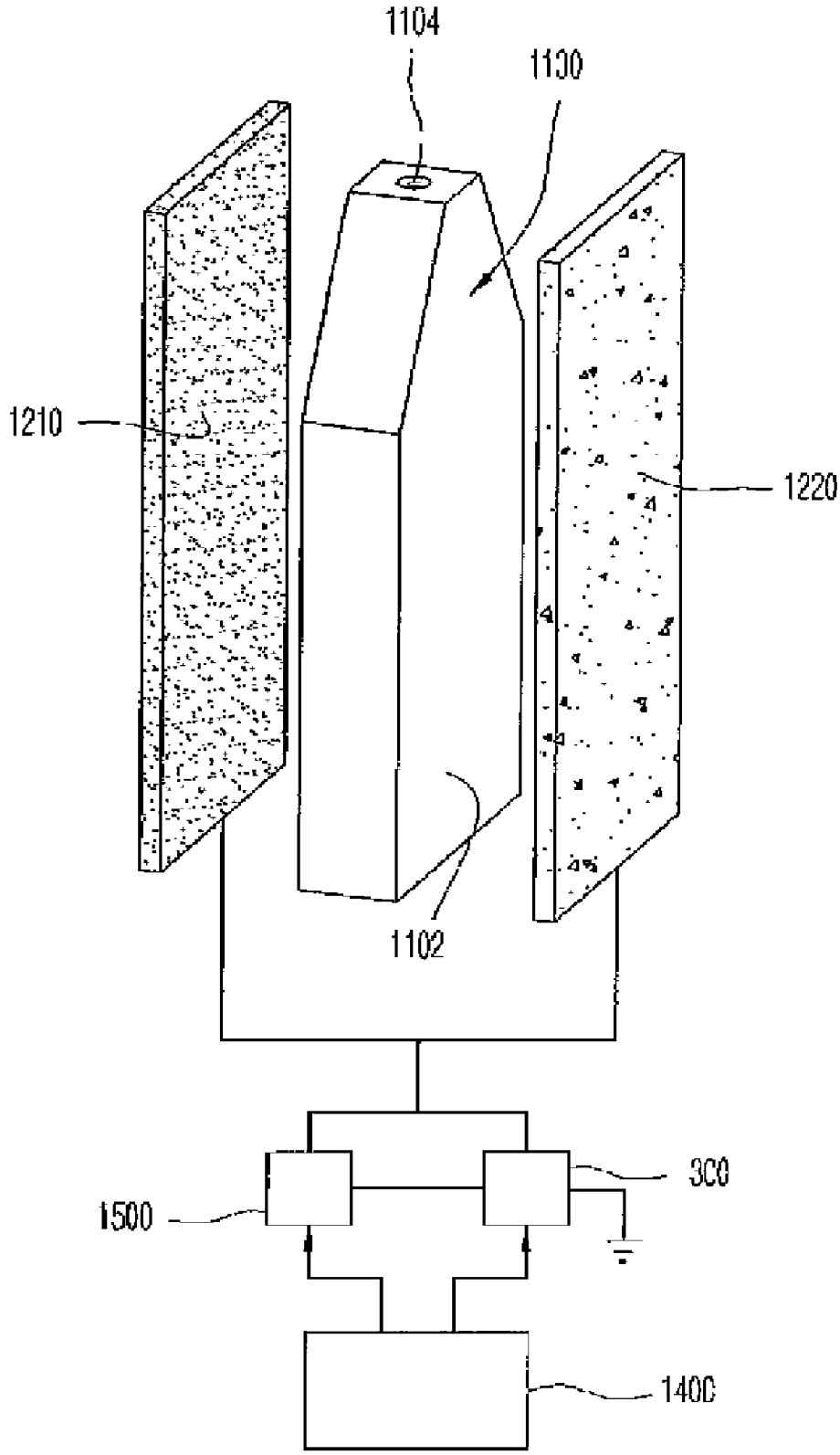
FIG. 16 is a schematic perspective view showing an electrostatic spray module according to a first exemplary embodiment of the present invention.

As shown in FIG. 16, the electrostatic spray module includes a nozzle body 1100, an electrode module unit having a first electrode unit 1210, a second electrode unit 1220, an alternating current signaler 1300, a pulse signaler 1500, and a signal control unit 1400.

The nozzle body 1100 will be described below.

As shown in FIGS. 16 to 23, the nozzle body 1100 includes a chamber 1102 and a nozzle 1104. The chamber 1102 provides a space in which a liquid droplet to be sprayed through the nozzle 1104, i.e., fluid is filed. The chamber 1102 is filed with a predetermined amount of fluid supplied from the outside.

Meanwhile, the nozzle 1104 is formed at one end of the chamber 1102 and communicates with the chamber 1102. As the fluid contained in the chamber 1102 is discharged through the nozzle 1104, the fluid is formed as a liquid droplet and is then sprayed to and arrives at one side of the material to be printed A.

The nozzle 1104 of the nozzle body 1100 may include a conductive material, or a non-conductive material in which a conductive wire is embedded. If the nozzle 14 is configured to be wholly made of the conductive material or to be partially embedded with the conductive wire, there is an advantage of increasing jetting efficiency. This is because an electric current induced by an external electrostatic force may be generated in the conductive material and thus the electrostatic force may be more strongly exerted to the fluid F.

Figure 17:
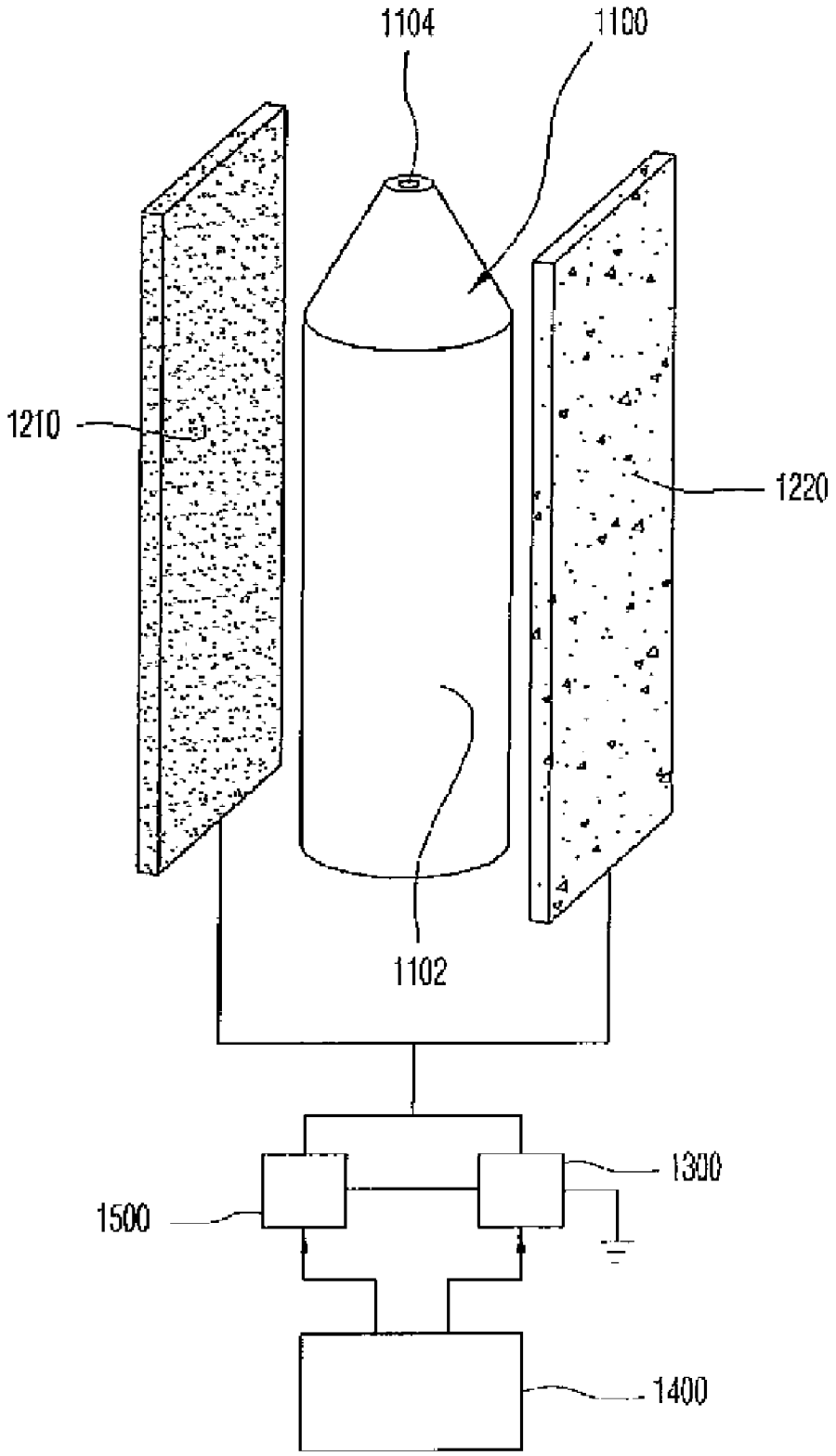
FIG. 17 is a schematic perspective view showing another electrostatic spray module according to a first exemplary embodiment of the present invention.

As described above, the nozzle body 1100 including the chamber 1102 and the nozzle 1104 may have various shapes. As shown in FIG. 16, the nozzle body 1100 may be formed as a flat plate type having a cross-section tapering toward the nozzle 14, thereby having a structure advantageous to integration. As shown in FIG. 17, the nozzle body 1100 may be formed as a cylindrical type having a cross-section tapering toward the nozzle 14. Besides these shapes, various shapes may be applied to the nozzle body 1100.

With the nozzle body 1100 configured as described above, a predetermined amount of fluid is supplied to and contained in the chamber 1102, and then sprayed to the material to be printed A through the nozzle 1104.

The electrode module unit including the first electrode unit 1210 and the second electrode unit will be described below.

The electrode module unit is arranged to surround the nozzle 1104 of the nozzle body 1100. For example, as shown in FIG. 16, the electrode module unit may include the first electrode unit 1210 arranged to be attached to or spaced apart from the outer surface of the nozzle body 1100, and the second electrode unit 1220 arranged to be attached to or spaced apart from the outer surface of the nozzle body 1100 so as to be spaced apart from the first electrode unit 1210.

At this time, the first electrode unit 1210 and the second electrode unit 1220 are symmetrical to each other with respect to the nozzle body 1100.

The first electrode unit 1210 and the second electrode unit 1220 receive an alternating current signal from the alternating current signaler 1300, and a pulse signal from the pulse signaler 1500 and form an electrostatic field. Specifically, as a first configuration, the first electrode unit 1210 may be arranged to be attached to or spaced apart from one side of the outer surface of the nozzle body 1100, and the second electrode unit 1220 may be arranged to be attached to or spaced apart from the other side of the outer surface of the nozzle body 1100 (refer to FIGS. 16 and 17).

Figure 18:
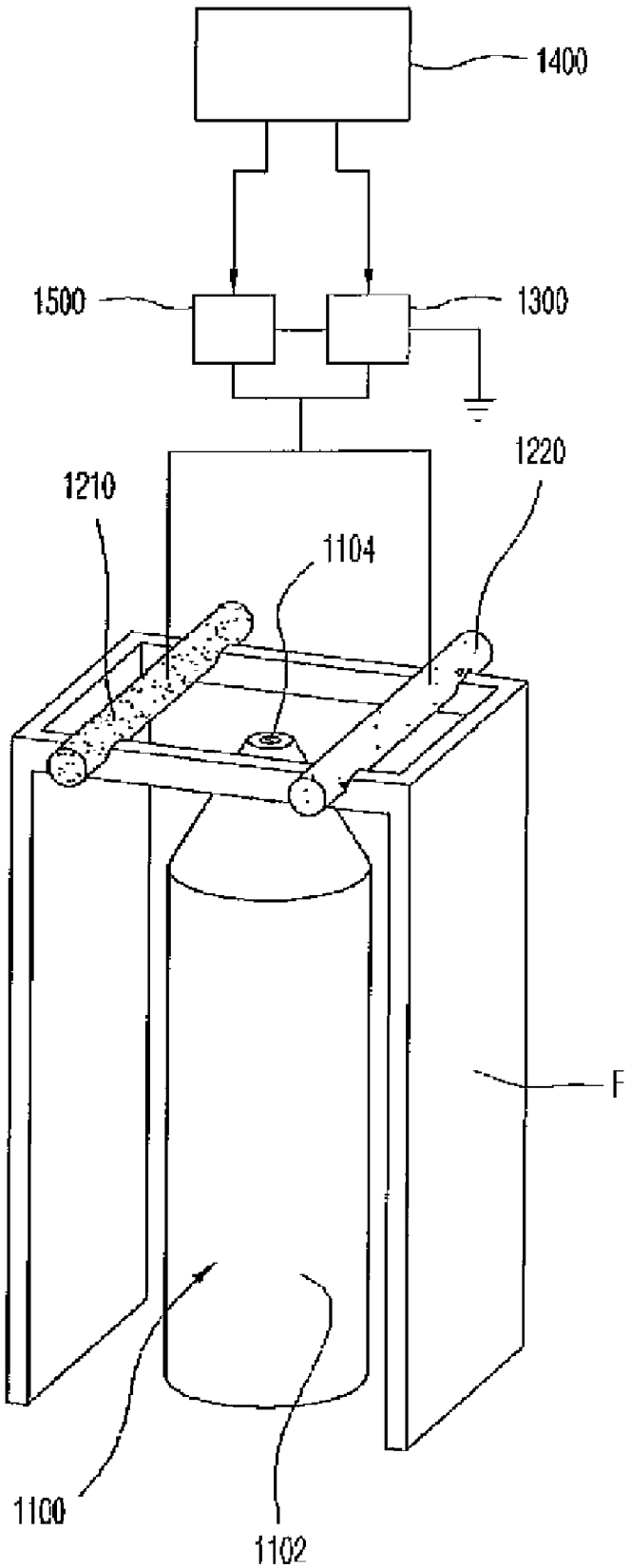
FIG. 18 is a schematic perspective view showing an electrostatic spray module according to a second exemplary embodiment of the present invention.

As a second configuration for the first electrode unit 1210 and the second electrode unit 1220, the first electrode unit 1210 may be arranged to be spaced apart from one side of the nozzle 1104 of the nozzle body 1100, and the second electrode unit 1220 may be arranged to be spaced apart from the other side of the nozzle 1104 of the nozzle body 1100 (refer to FIG. 18).

Figure 19:
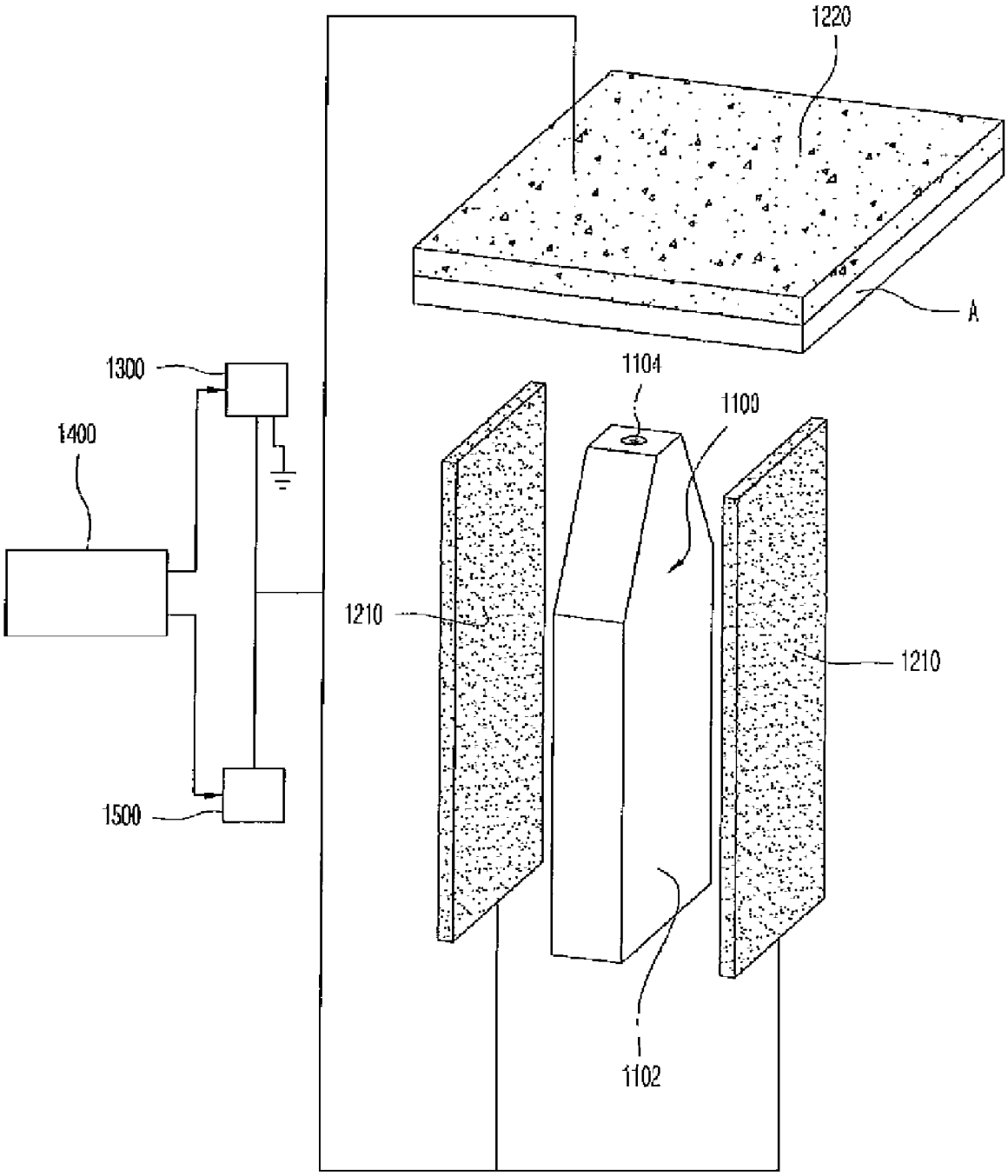
FIG. 19 is a schematic perspective view showing an electrostatic spray module according to a third exemplary embodiment of the present invention.

As a third configuration for the first electrode unit 1210 and the second electrode unit 1220, a pair of first electrode units 1210 may be arranged to be respectively spaced apart from opposite outer sides of the nozzle body 1100, and the second electrode unit 1220 may be arranged to be attached to or spaced apart from the other side of the material to be printed A (refer to FIG. 19).

Figure 20:
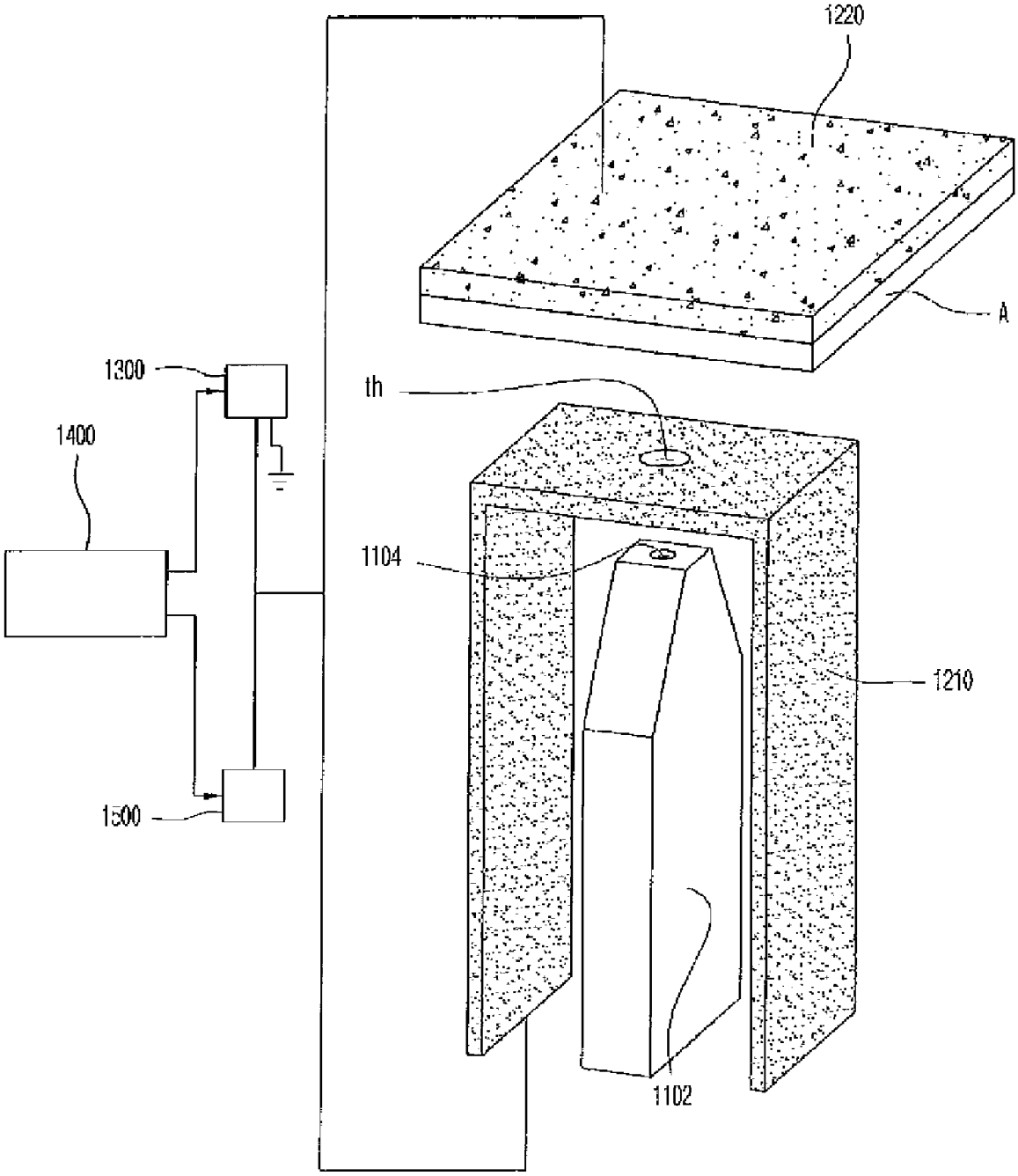
FIG. 20 is a schematic perspective view showing an electrostatic spray module according to a fourth exemplary embodiment of the present invention.

As a fourth configuration for the first electrode unit 1210 and the second electrode unit 1220, the first electrode units 1210 may be integrally arranged to be respectively spaced from the opposite outer sides of the nozzle body 1100 and the nozzle 1104, and be formed with a through hole th through which the liquid droplet sprayed from the nozzle 1104 to one side of the material to be printed A passes, and the second electrode unit 1220 may be arranged to be attached to or spaced apart from the other side of the material to be printed A (refer to FIG. 20).

Figure 21:
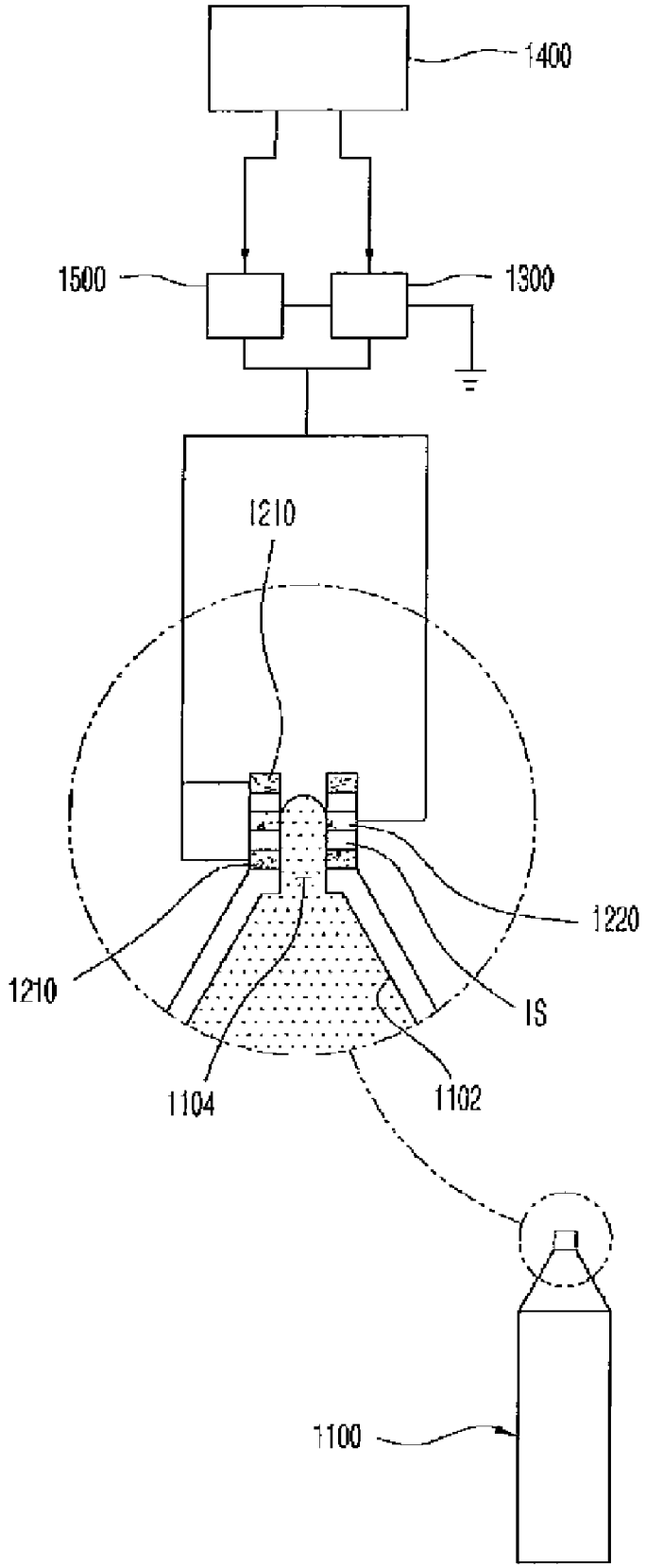
FIG. 21 is a schematic perspective view showing an electrostatic spray module according to a fifth exemplary embodiment of the present invention.

As a fifth configuration for the first electrode unit 1210 and the second electrode unit 1220, the first electrode unit 1210 and the second electrode unit 1220 are stacked to each other with the insulating spacer IS therebetween, and the first electrode unit 1210 and the second electrode unit 1220 stacked to each other may be provided being attached to the outer circumference of the nozzle 1104 (refer to FIG. 21).

Figure 22:
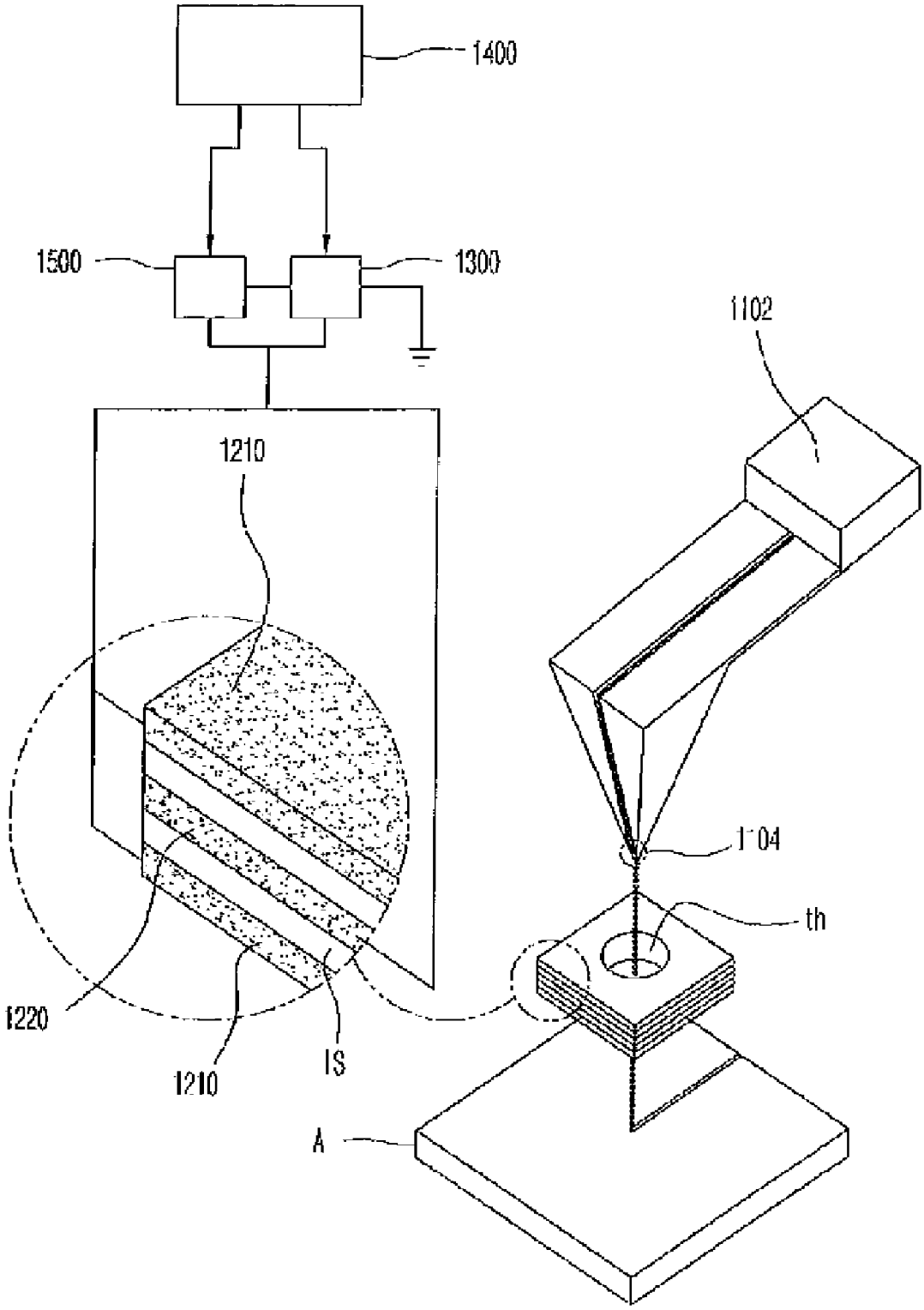
FIG. 22 is a schematic perspective view showing an electrostatic spray module according to a sixth exemplary embodiment of the present invention.

As a sixth configuration for the first electrode unit 1210 and the second electrode unit 1220, the first electrode unit 1210 and the second electrode unit 1220 are stacked to each other with the insulating spacer IS therebetween, and the first electrode unit 1210 and the second electrode unit 1220 stacked to each other may be arranged being spaced apart from the outer circumference of the nozzle 1104, in which a through hole th through which the liquid droplet sprayed from the nozzle 1104 to one side of the material to be printed A passes may be formed (refer to FIG. 22).

Figure 23:
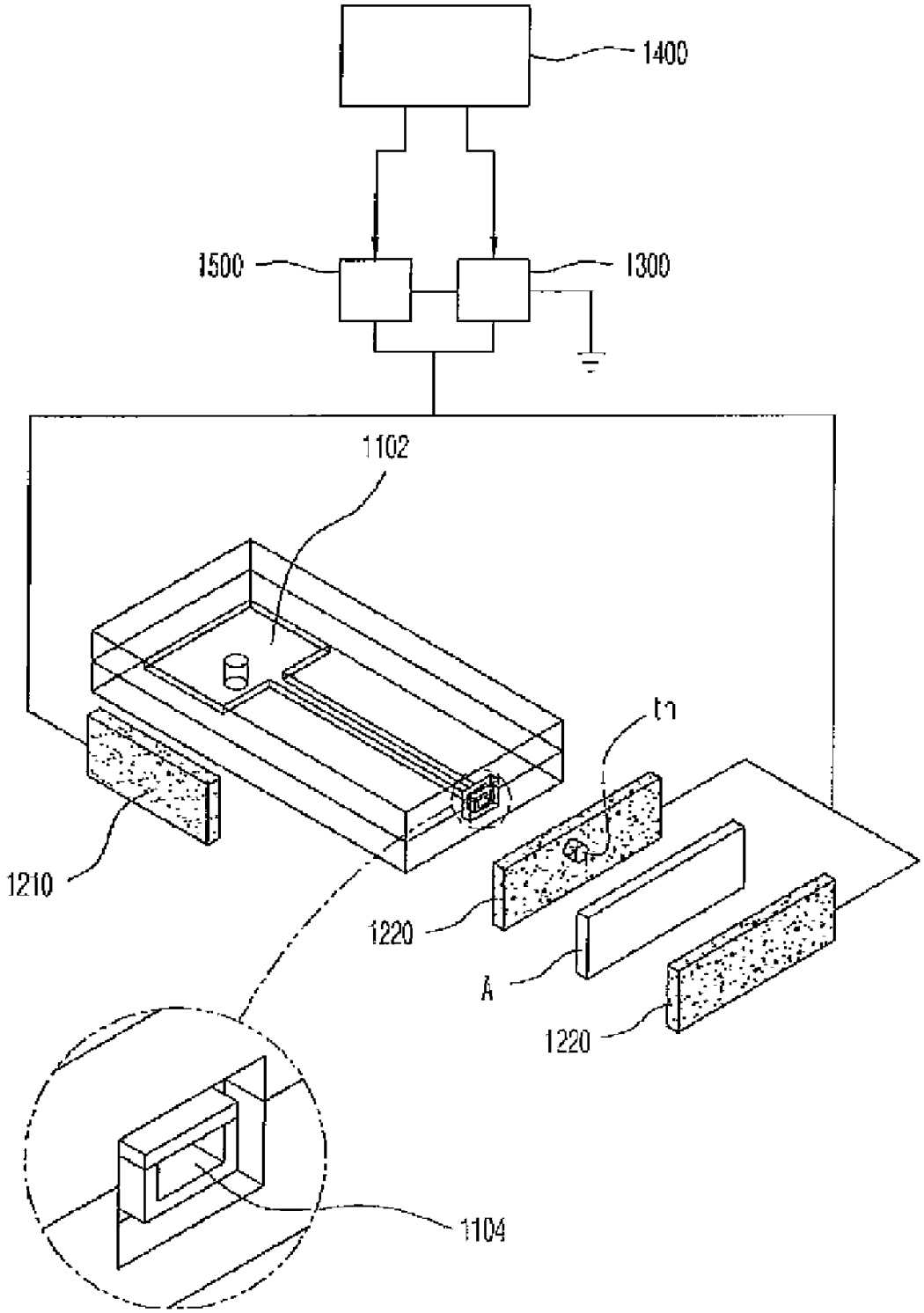
FIG. 23 is a schematic perspective view showing an electrostatic spray module according to a seventh exemplary embodiment of the present invention.

As a seventh configuration for the first electrode unit 1210 and the second electrode unit 1220, the first electrode unit 1210 may be arranged to be spaced apart from one side of the nozzle body 1100, and the second electrode 1220 may be formed with a through hole th through which the liquid droplet sprayed from the nozzle 1104 to one side of the material to be printed A passes, and be arranged to be spaced apart from one side or the other side of the material to be printed A (refer to FIG. 23).

With the foregoing configuration as above, the first electrode unit 1210 an the second electrode unit 1120 are interactively arranged to be attached to or spaced part from the outside of the nozzle body 1100, and receive an alternating current signal from the alternating current signaler 1300 and a pulse signal from the pulse signaler 1500 to thus form an electrostatic field so that electrical charges can be induced in the liquid droplet contained in the chamber 1102 of the nozzle body 1100.

Below, the alternating current signaler 1300, a pulse signal unit 1500 and a signal control unit 1400 will be described.

The alternating current signaler 1300 applies an alternating current signal to the first electrode unit 1210 and the second electrode unit 1220. When the alternating current signal is applied to the first electrode unit 1210 and the second electrode unit 1220, electrical charges are induced in the liquid droplet contained in the chamber 1102 of the nozzle body 1100.

At this time, the electrostatic force is formed on the liquid surface by the electrical charges induced in the liquid surface of the fluid, and the liquid droplet is discharged when the electrostatic force overcomes the surface tension of the liquid surface.

That is, in light of applying an alternating current signal, if the intensity of the alternating current signal is controlled not to overcome the surface tension of the liquid surface, the liquid droplet is not discharged. If the intensity of the alternating current signal is controlled to overcome the surface tension of the liquid surface, the liquid droplet is discharged.

As described above, if not the alternating current signal but a direct current signal is used, there is a problem that the liquid droplet is not continuously discharged.

This is because the direct current signal induces only the same (positive or negative) electrical charges in the liquid surface and a lot of electrical charges are discharged by the initial discharge of the liquid droplet so that the liquid droplet cannot be discharged any more. For example, the pulse signal has a very rapidly varied voltage at a positive edge or a negative edge of the pulse signal, and the same (positive or negative) electrical charges are concentrated. Of course, a concentrating time of the electrical charges is extremely short and thus its efficiency is also lowered. Also, the voltage variation is '0' in a signal excluding such an edge part, so that the electrical charges cannot be induced in the liquid surface. Accordingly, the direct current signal cannot be used for discharging the liquid droplet.

In this exemplary embodiment, the liquid droplet is discharged by controlling the intensity of the alternating current signal as described above. Also, a switching system of controlling a signal is required in order to control many nozzles individually. This case is improper for switching high voltage, so that instead of direct control the pulse signal can be additionally applied from the pulse signal unit 1500 to the first electrode unit 1210 and the second electrode unit 1220 in the state that the alternating current signal is applied as a bias to the first electrode unit 1210 and the second electrode unit 1220, thereby discharging the liquid droplet. Here, the pulse signal unit 1500 provides a sine wave signal in the form of a pulse, and a pulse supplying time is determined by the signal control unit 1400.

Here, the pulse supplying time is to apply a pulse signal with predetermined intensity at a peak point of the alternating current signal provided by the alternating current signaler 1300. That is, the pulse signal for spraying the liquid droplet is applied in the state that a bias is applied by the alternating current signal. The alternating current signal is supplied to the first electrode unit 1210 and the second electrode unit 1220 and induces a biased state of each electrode, thereby charging the liquid droplet with electricity. At this time, the liquid droplet is not discharged as being charged with electricity. To this end, the intensity of the alternating current signal is determined. The intensity of the alternating current signal is varied depending on the amount of liquid droplet and the capacity of the chamber 1102, and may be determined on the basis of experiments.

Thus, after the bias is applied to the first electrode unit 1210 and the second electrode unit 1220, the pulse signal is applied at a peak point of the alternating current signal closest to a point of time when the liquid droplet is required to be sprayed. If the pulse signal is supplied in the state that the liquid droplet is charged with electricity by the bias, voltage variation (dV/dt) is the highest at the positive edge or the negative edge of the pulse signal, and this voltage variation induces the electric field. Such an electric field induces the liquid droplet to have the same polarity and thus there is a repulsive force between molecules of the liquid droplet. Therefore, the liquid droplet is discharged at a supplying time for the pulse signal (i.e., the positive or negative edge).

Figure 28:
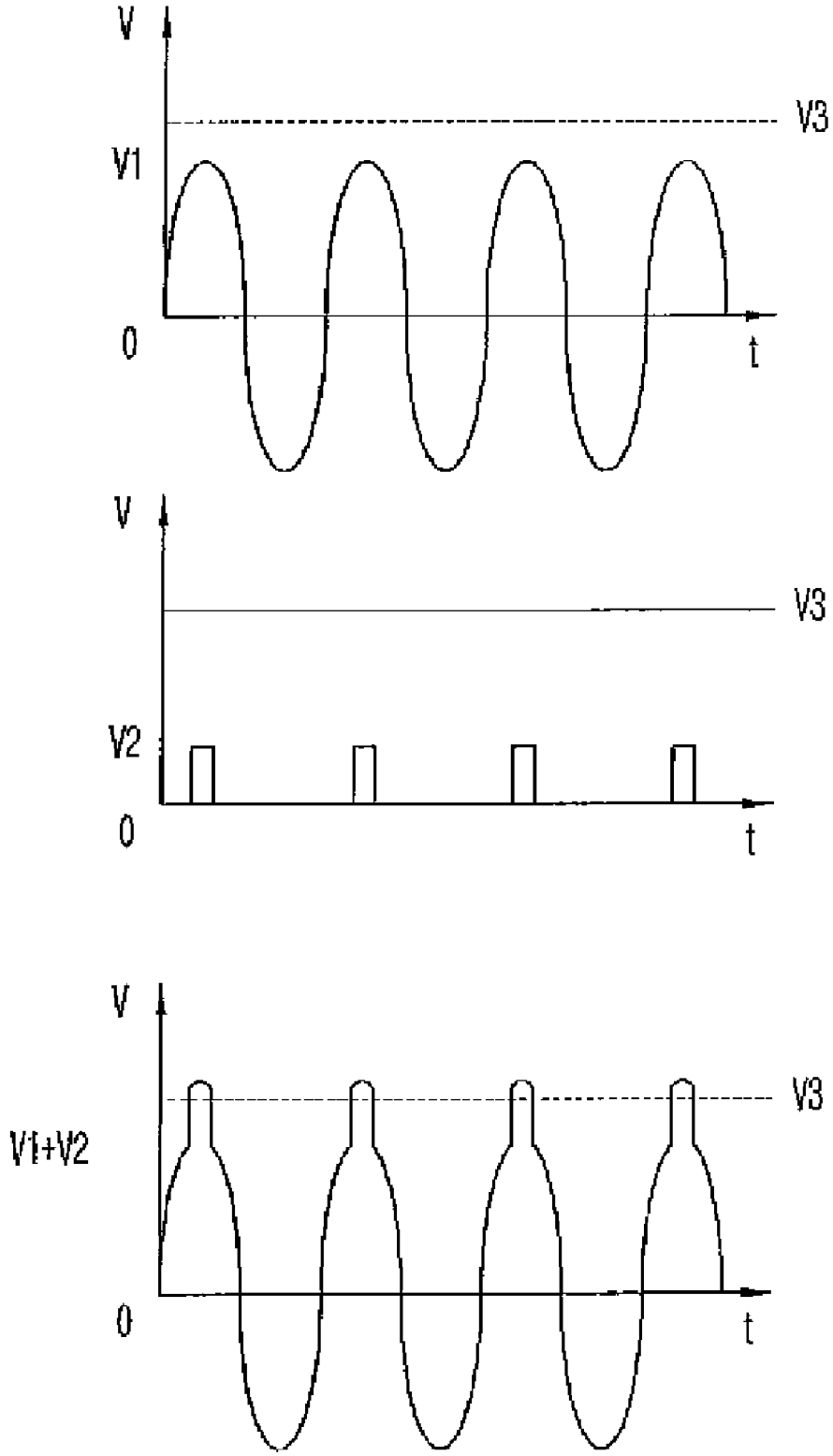
FIGS. 28 and 29 are graphs for explaining an alternating current signal applied from an alternating current signaler of the electrostatic spray module according to an exemplary embodiment of the present invention.

That is, in the state that the alternating current signaler 1300 applies the alternating current signal for discharging no liquid droplet like V1 of FIG. 28, as the bias to the first and second electrode units 1210 and 1220, if the pulse signal unit 1500 applies the pulse signal like V2 of FIG. 28 to the first and second electrode units 1210 and 1220, a synthesized signal of the alternating current signal and the pulse signal is applied like V3 of FIG. 28, thereby discharging the liquid droplet only when the pulse signal is applied.

Figure 29:
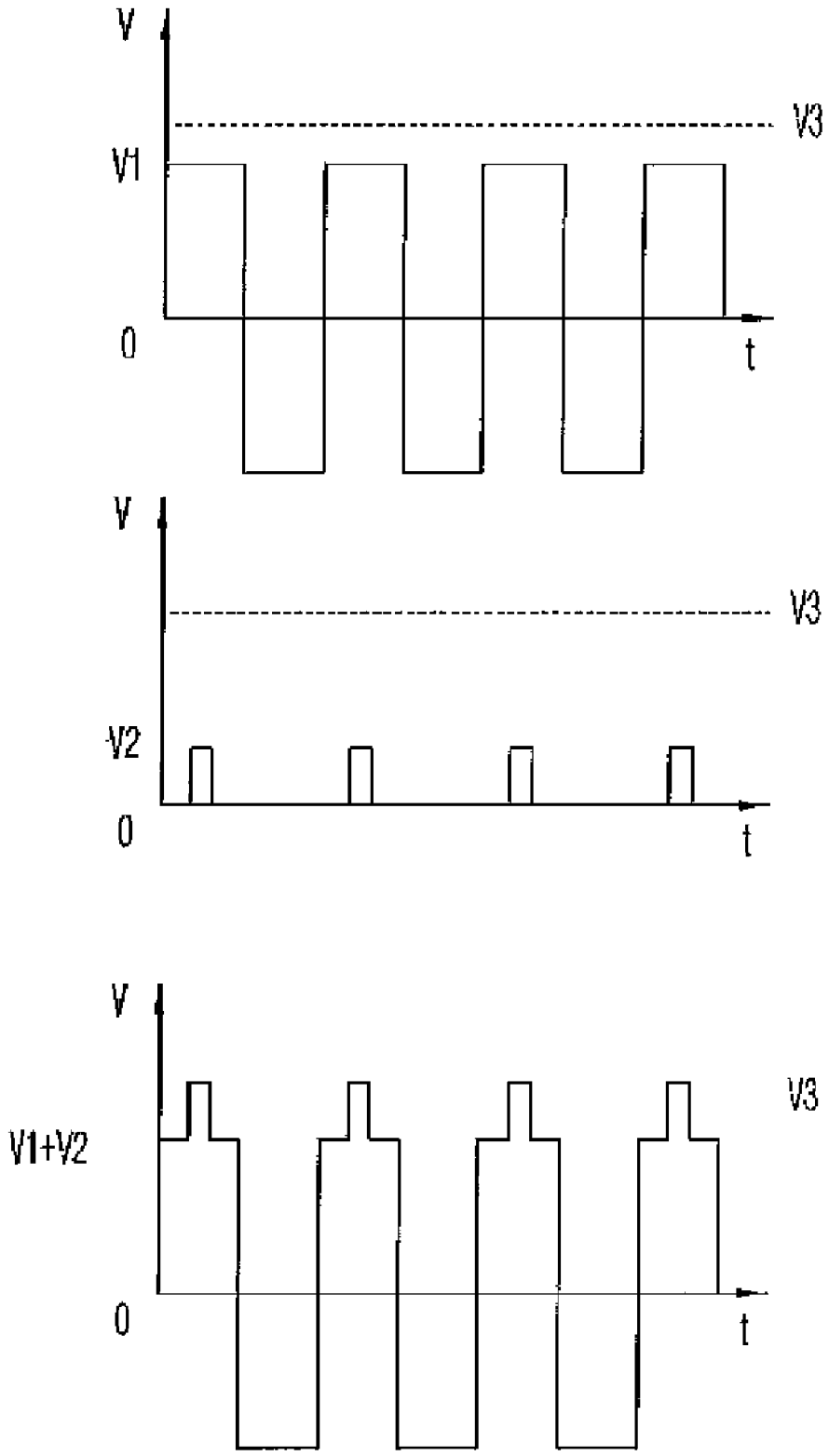

Here, in the state that the alternating current signaler 1300 applies the alternating current signal for discharging no liquid droplet like V1 of FIG. 29, as the bias to the first and second electrode units 1210 and 1220, if the pulse signal unit 1500 applies the pulse signal like V2 of FIG. 29 to the first and second electrode units 1210 and 1220, a synthesized signal like V3 of FIG. 29 may be used.

The signal control unit 1400 controls the intensity of the alternating current signal applied from the alternating current signaler 1300 to the first and second electrode units 1210 and 1220 and at the same time controls the pulse signal applied from the pulse signal unit 1500 to the first and second electrode units 1210 and 1220, thereby controlling the liquid droplet to be discharged at specific time intervals.

With the alternating current signaler 1300, the pulse signal unit 1500 and the signal control unit 1400 configured as described above, when the fluid contained in the chamber 1102 of the nozzle body 1100 is discharged through the nozzle 1104 of the nozzle body 1100, the liquid droplet can be discharged at specific time intervals desired by a user.

Meanwhile, a structure where a plurality of nozzle bodies 1100 having the foregoing configuration is arranged will be described below.

In the structure where the plurality of nozzle bodies 1100 are integrally arranged, the insulating spacers IS may be interposed between nozzle bodies 1100 so that the nozzle bodies 1100 can be arranged neighboring to each other.

Figure 24:
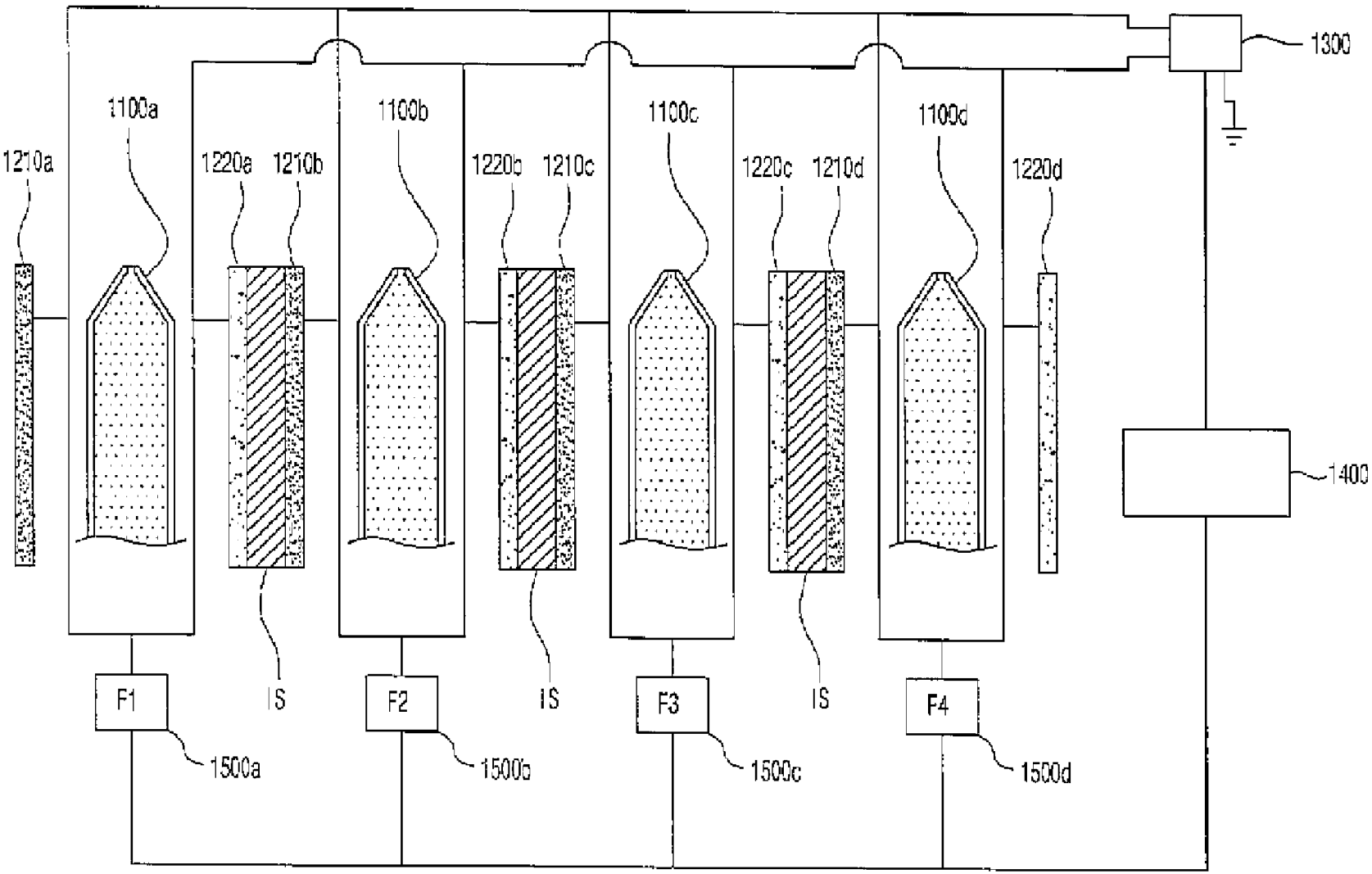
FIG. 24 is a conceptive view showing that a plurality of electrostatic spray modules according to an exemplary embodiment of the present invention are arranged neighboring to each other.

Referring to FIG. 24, a first nozzle body 1100*a*, a second nozzle body 1100*b*, a third nozzle body 1100*c* and a fourth nozzle body 1100*d* are arranged neighboring to each other, first and second electrode units 1210*a* and 1220*a* are provided at opposite sides of the first nozzle body 1100*a*, first and second electrode units 1210*b* and 1220*b* are provided at opposite sides of the second nozzle body 1100*b*, first and second electrode units 1210*c* and 1220*c* are provided at opposite sides of the third nozzle body 1100*c*, and first and second electrode units 1210*d* and 1220*d* are provided at opposite sides of the fourth nozzle body 1100*d*.

Further, the insulating spaces IS are interposed between the second electrode unit 1220*a* and the first electrode unit 1210*b*, between the second electrode unit 1220*b* and the first electrode unit 1210*c*, and between the second electrode unit 1220*c* and the first electrode unit 1210*d*.

The first electrode units 1210*a*, 1210*b*, 1210*c* and 1210*d* and the second electrode units 1220*a*, 1220*b*, 1220*c* and 1220*d* are connected to the alternating current signaler 1300 and receive an alternating current signal. At this time, the applied alternating current signal is not for discharging the liquid droplet like V1 of FIG. 28, and used as a bias.

Also, a first pulse signal unit 1500*a* is connected between the first electrode unit 1210*a* and the second electrode unit 1220*a*, a second pulse signal unit 1500*b* is connected between the first electrode unit 1210*b* and the second electrode unit 1220*b*, a third pulse signal unit 1500*c* is connected between the first electrode unit 1210*c* and the second electrode unit 1220*c*, and a fourth pulse signal unit 1500*d* is connected between the first electrode unit 1210*d* and the second electrode unit 1220*d*.

Figure 25:
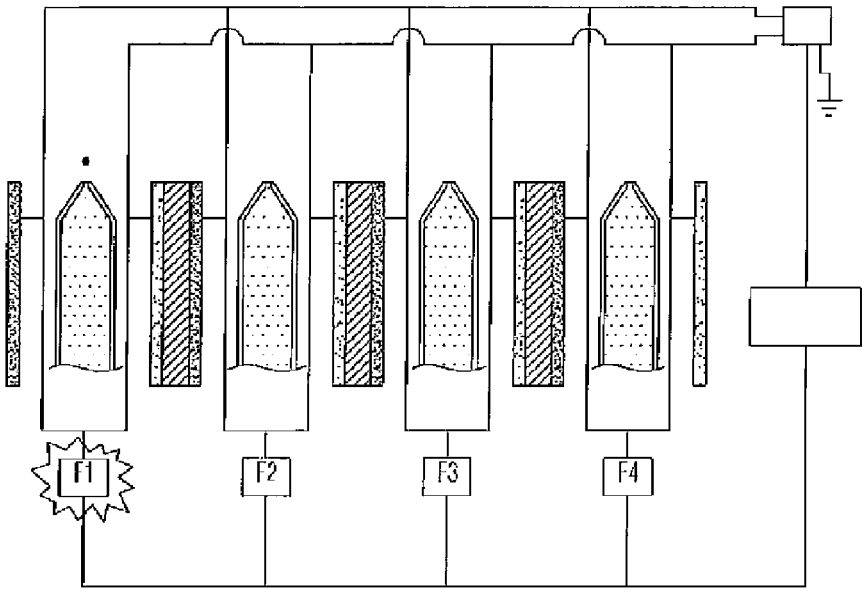
FIGS. 25 to 27 are operational views showing that a plurality of electrostatic spray modules according to an exemplary embodiment of the present invention operates in the state that they are arranged neighboring to each other.
Figure 26:
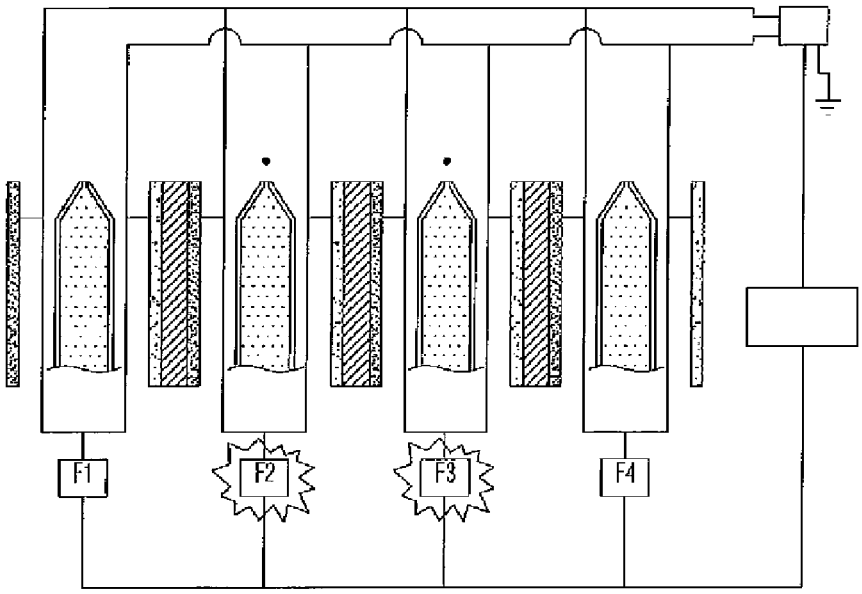
Figure 27:
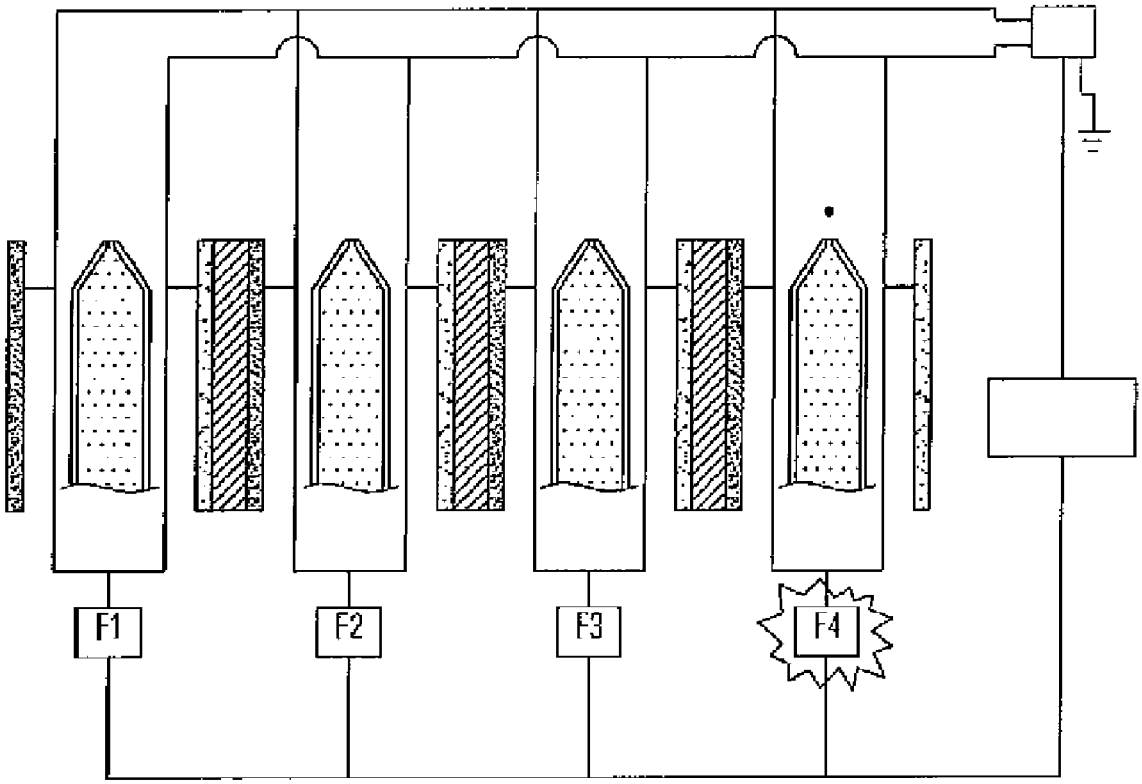

Thus, as shown in FIG. 25, if a pulse signal is applied to the first electrode unit 1210*a* and the second electrode unit 1220*a* trough the first pulse signal unit 1500*a*, the liquid droplet is discharged and sprayed from the first nozzle body 1100*a*. As shown in FIG. 26, if a pulse signal is applied to the first electrode unit 1210*b* and the second electrode unit 1220*b* trough the second pulse signal unit 1500*b* and at the same time a pulse signal is applied to the first electrode unit 1210*c* and the second electrode unit 1220*c* trough the third pulse signal unit 1500*c*, the liquid droplet is discharged and sprayed from the second nozzle body 1100*b* and the third nozzle body 1100*c*. As shown in FIG. 27, if a pulse signal is applied to the first electrode unit 1210*d* and the second electrode unit 1220*d* trough the fourth pulse signal unit 1500*d*, the liquid droplet is discharged and sprayed from the fourth nozzle body 1100*d*. That is, it is possible to control the liquid droplets respectively discharged from the nozzle bodies 1100*a*, 1100*b*, 1100*c* and 1100*d*.

Meanwhile, in the electrostatic spray module configured as described above, a method of spraying a liquid droplet will be described.

A liquid droplet spraying method based on the electrostatic spray module configured as described above includes a) preparing a nozzle body that includes a chamber 1102 containing a predetermined amount of fluid supplied from the outside, and a nozzle 1104 communicating with the chamber and spraying a liquid droplet of the fluid contained in the chamber 1102 toward one side of the material to be printed A;

b) arranging an electrode module unit to be attached to or spaced apart from one side of the outside of the nozzle body 1100; and c) applying an alternating current signal to the electrode module unit.

That is, as an alternating current signal is applied to the electrode module unit (a pair of first and second electrode units 1210 and 1220) arranged to be attached to or spaced apart from the outside of the nozzle body 1100 that includes a chamber 1102 containing the fluid and a nozzle 1104 for discharging the fluid to form a liquid droplet, electrical charges are induced in the liquid surface of the fluid contained in the chamber 1102 of the nozzle body 1100 and form the electrostatic force in the liquid surface. If the electrostatic force overcomes the surface tension of the liquid surface, the liquid droplet is discharged.

In light of applying the alternating current signal, if the intensity of the alternating current signal is controlled not to overcome the surface tension of the liquid surface, the liquid droplet is not discharged. On the other hand, if the intensity of the alternating current signal is controlled to overcome the surface tension of the liquid surface, the liquid droplet is discharged.

Another liquid droplet spraying method based on the electrostatic spray module configured as described above includes a) preparing a nozzle body that includes a chamber 1102 containing a predetermined amount of fluid supplied from the outside, and a nozzle 1104 is communicating with the chamber and spraying a liquid droplet of the fluid contained in the chamber 1102 toward one side of the material to be printed A;

b) arranging an electrode module unit to be attached to or spaced apart from one side of the outside of the nozzle body 1100;

c) applying an alternating current signal as a bias to the electrode module unit; and d) applying a pulse signal to the electrode module unit.

That is, the liquid droplet is sprayed as a pulse signal is applied to the electrode module unit (a pair of first and second electrode units 1210 and 1220) in the state that an alternating current signal is applied as a bias to the electrode module unit (the pair of first and second electrode units 1210 and 1220) arranged to be attached to or spaced apart from the outside of the nozzle body 1100 that includes a chamber 1102 containing the fluid and a nozzle 1104 for discharging the fluid to form a liquid droplet.

Specifically, the liquid droplet is discharged as the pulse signal is additionally applied to the electrode module unit (a pair of first and second electrode units 1210 and 1220) in the state that the alternating current signal is applied as the bias to the electrode module unit (the pair of first and second electrode units 1210 and 1220). Further, in the state that the alternating current signal is applied for discharging no liquid droplet like V1 of FIG. 28, as the bias to the electrode module unit (the pair of first and second electrode units 1210 and 1220), if the pulse signal unit 1500 applies the pulse signal like V2 of FIG. 28 to the electrode module unit (the pair of first and second electrode units 1210 and 1220), a synthesized signal of the alternating current signal and the pulse signal is applied like V3 of FIG. 28 to the electrode module unit (the pair of first and second electrode units 1210 and 1220), thereby discharging the liquid droplet only when the pulse signal is applied.

In the liquid droplet spraying apparatus and method as described above, another configuration and spray method of the electrostatic spray nozzle will be described.

What is claimed is:

1. A liquid droplet spraying apparatus with a nozzle body that comprises a chamber containing a fluid, and a nozzle for spraying the fluid contained in the chamber toward one side of a material to be printed, the liquid droplet spraying apparatus comprising:

an electrostatic spray module which is arranged in the vicinity of the chamber or the nozzle and forms an electrostatic field in the fluid contained in the chamber to provide a first spray force so that the fluid can be sprayed through the nozzle to form a liquid droplet;

a physical spray module which is arranged inside the chamber and opposite the nozzle, and provides a second spray force for assisting the first spray force when the first spray force is generated; and a control unit which controls the electrostatic spray module and the physical spray module so that the first spray force and the second spray force can be provided in a specific pattern, wherein the electrostatic spray module comprises a first electrode unit arranged to be spaced apart from the nozzle, a second electrode unit arranged in an inside of the nozzle, and an electrostatic signaler applying an electrostatic signal between the first electrode unit and the second electrode unit, the physical spray module comprises a piezoelectric operator or a heating operator, and a driving signaler for applying a driving signal to the piezoelectric operator or the heating operator, and wherein multiple nozzle bodies are arranged in plural neighboring to each other, and insulating spacers are arranged on a front side of each nozzle body to provide electrical insulation between the first electrode unit and the second electrode unit and to exclude interference of electric field between a plurality of nozzle bodies.

2. The liquid droplet spraying apparatus according to claim 1, wherein the first electrode unit comprises a plurality of stack electrodes stacked as being spaced apart from each other.

3. The liquid droplet spraying apparatus according to claim 1, wherein the first electrode unit comprises a front electrode arranged to be spaced apart from the nozzle, and a rear electrode arranged to be attached to or spaced apart from the other side of the material to be printed.

4. The liquid droplet spraying apparatus according to claim 1, wherein the electrostatic spray module comprises a first electrode unit arranged to be spaced apart from the nozzle, and an alternating current signaler for applying an alternating current signal to the first electrode unit.

5. The liquid droplet spraying apparatus according to claim 4, wherein the first electrode unit is arranged to be spaced apart at opposite sides of the nozzle.

6. The liquid droplet spraying apparatus according to claim 4, wherein the alternating current signal comprises a sine wave signal in the form of an alternating current.

7. The liquid droplet spraying apparatus according to claim 4, wherein the first electrode unit comprises a plurality of stack modules stacked as being spaced apart from each other.

8. The liquid droplet spraying apparatus according to claim 4, wherein the first electrode unit comprises a front electrode arranged to be spaced apart from the nozzle, and a rear electrode arranged to be attached to or spaced apart from the other side of the material to be printed.

9. The liquid droplet spraying apparatus according to claim 1, wherein each electrostatic spray module and each physical spray module of the plural nozzle bodies arranged neighboring to each other are individually controlled.

* * * * *